US009298120B2

(12) United States Patent
Hano et al.

(10) Patent No.: US 9,298,120 B2
(45) Date of Patent: Mar. 29, 2016

(54) IMAGE FORMING APPARATUS

(71) Applicant: CANON KABUSHIKI KAISHA, Tokyo (JP)

(72) Inventors: Masami Hano, Abiko (JP); Masahiro Makino, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/713,798

(22) Filed: May 15, 2015

(65) Prior Publication Data

US 2015/0261115 A1 Sep. 17, 2015

Related U.S. Application Data

(63) Continuation of application No. PCT/JP2013/081460, filed on Nov. 15, 2013.

(30) Foreign Application Priority Data

Nov. 16, 2012 (JP) ..... 2012-252743

(51) Int. Cl.
*G03G 15/00* (2006.01)
*G03G 15/02* (2006.01)
*G03G 21/20* (2006.01)

(52) U.S. Cl.
CPC ..... *G03G 15/0266* (2013.01); *G03G 15/80* (2013.01); *G03G 21/20* (2013.01); *G03G 2215/0129* (2013.01)

(58) Field of Classification Search
CPC ... G03G 15/0266; G03G 15/80; G03G 21/20; G03G 2215/0129
See application file for complete search history.

(56) References Cited

U.S. PATENT DOCUMENTS

| | | | | |
|---|---|---|---|---|
| 6,615,002 | B2 | 9/2003 | Saito et al. | |
| 2003/0215253 | A1* | 11/2003 | Okano | G03G 21/1889 399/50 |
| 2003/0219268 | A1* | 11/2003 | Sunahara | G03G 15/0266 399/50 |
| 2007/0091657 | A1* | 4/2007 | Uchitani | G03G 15/0266 363/65 |
| 2013/0230330 | A1* | 9/2013 | Mochiduki | G03G 15/55 399/12 |
| 2014/0294409 | A1* | 10/2014 | Murata | G03G 15/161 399/44 |
| 2015/0192877 | A1* | 7/2015 | Fujioka | G03G 15/0189 399/43 |

FOREIGN PATENT DOCUMENTS

| | | |
|---|---|---|
| JP | 2002-049225 A | 2/2002 |
| JP | 2006-010903 A | 1/2006 |
| JP | 2008-191620 A | 8/2008 |

* cited by examiner

*Primary Examiner* — Francis Gray
(74) *Attorney, Agent, or Firm* — Fitzpatrick, Cella, Harper & Scinto

(57) ABSTRACT

Non-uniform charged potential of a surface of a photosensitive member is suppressed even when a temperature of a charging member newly mounted to an image forming apparatus by exchange is lower than a temperature inside the image forming apparatus. The image forming apparatus includes the photosensitive member, a charge portion, an applying portion for applying a charging bias voltage to the charge portion, a toner image forming portion for forming a toner image on the photosensitive member, a transfer portion, a fixing portion, a first casing accommodating them, and a second casing having a recording material accommodating portion for accommodating a recording material.

6 Claims, 15 Drawing Sheets

IMAGE FORMING APPARATUS

FIELD OF THE INVENTION

The present invention relates to an image forming apparatus such as a copying machine or printer using an electrophotographic type or electrostatic recording type process.

BACKGROUND ART

Recently, as for a charging type for charging an image bearing member such as a photosensitive member or a dielectric member in an image forming apparatus using the electrophotographic type or the electrostatic recording type process, a contact charging type or a proximity charging type is used. In the contact charging type or proximity charging type, a charging member (charging roller) of an electroconductive roller type, for example, is provided contacted to or close to the image bearing member, and a voltage (charging bias voltage) is supplied to the charging member.

For example, an electroconductive rubber roller is contacted to the photosensitive member as the image bearing member, and is rotated by the photosensitive member, wherein a core metal as a rotation shaft of the rubber roller is supplied with a voltage so that the photosensitive member is uniformly charged. In this case, by the application of the voltage to the charging roller, the photosensitive member is charged by electric discharge produced in the fine gap between the charging roller and the photosensitive member.

It is not inevitable that the charging member such as the charging roller is contacted to the surface of the photosensitive member which is a member to be charged. The charging member and the photosensitive member may be disposed close to each other without contact but with the gap such as several 10 μm, if a dischargeable region as determined by a voltage across the gap by a corrected Paschen curve is assured. Here, the contact charging type or proximity charging type is a type in which the charging member is contacted to or disposed close to the member to be charged to produce electronic discharge in the fine gap, by which the member to be charged is charged.

As for the applying type of the voltage to the charging member in the contact charging type or the proximity charging type, there is an AC charging type in which a DC voltage and an AC voltage are superimposed. In the AC charging type, an oscillating voltage comprising a DC component corresponding to a required surface potential of the photosensitive member and an AC component having a peak-to-peak voltage not less than 2-times a discharge starting voltage is supplied to the charging member as a charging bias voltage.

That is, in the AC charging type, the charging bias voltage applied to the charging member is a superimposed voltage of the AC component and the DC component (the voltage corresponding to the target charged potential), and a waveform of the AC component may be a sinusoidal wave, a rectangular wave or triangular wave. Or, the AC component may be a rectangular wave voltage provided by periodically rendering a DC voltage source ON and OFF.

In the AC charging type, if a value of the peak-to-peak voltage, which may be simply called "AC voltage" or "charging AC voltage", of the AC component of the oscillating voltage applied to the charging member is too small, a convergence property to the value of the DC component of the potential of the photosensitive member deteriorates, with a result of improper charging. In addition, when a discharge current value between the charging member and the photosensitive member varies as a result of variation of a resistance value due to a temperature change of the charging member such as the charging roller, and the temperature of the charging member lowers, an amount of the discharge current between the charging member and the photosensitive member is not enough, and by the convergence property of the surface potential of the photosensitive member toward the value of the DC component of the charging bias voltage, uneven charged potential of the photosensitive member is likely to occur.

As Japanese Laid-open Patent Application 2008-191620 discloses, it is known that a temperature sensor is provided in the image forming apparatus to control the charging bias voltage applied to the charging roller on the basis of the output of the temperature sensor.

However, even in the case that the charging bias voltage is controlled on the basis of the output of the temperature sensor provided in the image forming apparatus as disclosed in Japanese Laid-open Patent Application 2008-191620, the problem still exists, that is, when the charging member is a part of a process cartridge, for example, and it is exchangeable, the temperature detected by the in-apparatus temperature sensor may be different from the actual temperature of the charging member immediately after the replacement of the charging member. Particularly when the temperature of the new charging member mounted to the image forming apparatus by the replacement is lower than the temperature inside the image forming apparatus, the amount of the discharge current between the charging member and the photosensitive member is not enough, with the result of deteriorated convergence property of the surface potential of the photosensitive member toward the value of the DC component of the charging bias voltage, and therefore, uneven surface potential of the photosensitive member may occur.

SUMMARY OF THE INVENTION

Under the circumstances, according to the present invention, there is provided an image forming apparatus comprising a photosensitive member; a charge portion for charging said photosensitive member, said charge portion is capable of mounting to or dismounting from said image forming apparatus; an applying portion for applying to said charge portion a charging bias voltage comprising a DC voltage and a superimposed AC voltage; a toner image forming portion for forming a toner image on said photosensitive member charged by said charge portion; a transfer portion for transferring the toner image formed on said photosensitive member, onto a recording material; a fixing portion for fixing the transfer toner image on the recording material by heat and pressure; a first casing accommodating therein said photosensitive member, said charge portion, said applying portion, said toner image forming portion, said transfer portion and said fixing portion, said first casing being provided with an opening for permitting the recording material to enter; a second casing disposed at a lower position with respect to a vertical direction outside said first casing and accommodating therein a recording material accommodating portion which accommodates the recording material; a feeding portion for feeding the recording material into said first casing through said opening; a first temperature detecting portion, provided in said first casing, for detecting a temperature inside said first casing; a second temperature detecting portion, disposed in said second casing, for detecting a temperature inside said second casing; a mounting detecting portion for detecting a mounting operation of said charge portion to said image forming apparatus; and a setting portion for executing an operation in a first set mode for setting a peak-to-peak voltage of the AC voltage of said charging bias voltage on the basis of a detection result of said first temperature detecting portion, wherein when said mounting detecting portion detects the mounting operation, said setting portion executes an operation in a second set mode for setting the peak-to-peak voltage of the AC voltage on the basis of a detection result of a lower one of a temperature detected by said first temperature detecting portion and a temperature detected by said second temperature detecting portion.

DESCRIPTION OF THE EMBODIMENTS

An image forming apparatus according to an embodiment of the present invention will be described in conjunction with the accompanying drawings.

First, the description will be made as to an example of the image forming apparatus to which the embodiments can be applied.

Figure 1:
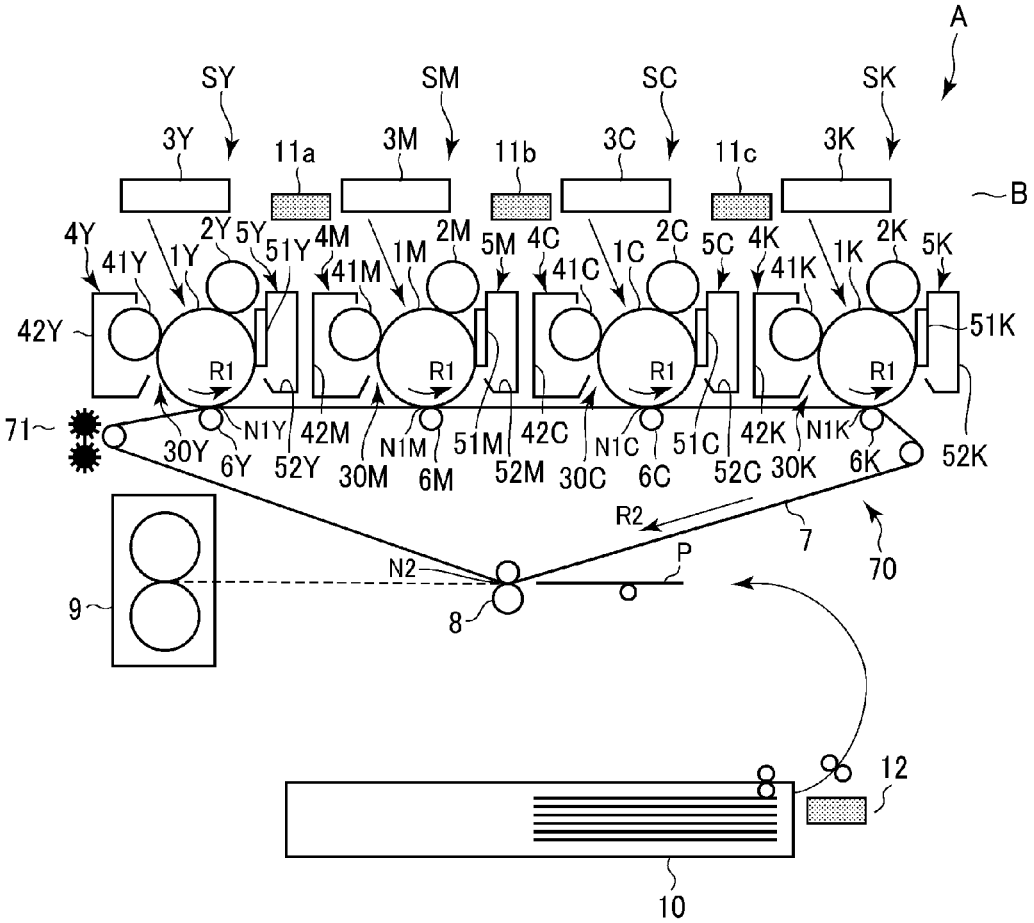
FIG. 1 shows a schematic illustration of an example of an image forming apparatus.

1. General Arrangement of the Image Forming Apparatus:

FIG. 1 is a schematic sectional view of an image forming apparatus A of this embodiment. This image forming apparatus A is an intermediary transfer type laser beam printer capable of forming a full-color image using an electrophotographic type process.

The image forming apparatus A comprises first, second, third and fourth image forming stations SY, SM, SC and SK for forming yellow (Y), magenta (M), cyan (C) and black (K) images, respectively. In this embodiment, structures and operations of the image forming stations SY, SM, SC, SK are substantially the same except that the colors of the toner are different. Therefore, the following description will be made commonly to them without suffixes Y, M, C and K indicative of the colors unless otherwise required.

The image forming station S includes a drum type photosensitive member (photosensitive drum) 1 as an image bearing member. The photosensitive member 1 is rotated in the direction indicated by an arrow R1 in the Figure (counterclockwise). Around the photosensitive member 1, various means are provided in a predetermined order along the rotational moving direction. First, there is provided a charging roller 2 which is a roller type charging member as a charge portion. Then, there is provided an exposure device (laser beam scanner) 3 as an exposed portion. Furthermore, there is provided a developing device 4 as a developing portion. A combination of the exposure device 3 and the developing device 4 is called toner image forming portion. Furthermore, a transferring device 70 as a transfer portion is provided. In addition, there is provided a photosensitive member cleaning device 5 as a photosensitive member cleaning means.

The transferring device 70 includes an intermediary transfer belt 7 which is an endless belt intermediary transfer member. The intermediary transfer belt 7 is stretched around a plurality of stretching rollers with the predetermined tension. The intermediary transfer belt 7 is rotated in a direction indicated by an arrow R2 in the Figure (clockwise). In an inner surface side of the intermediary transfer belt 7, primary transfer rollers 6Y, 6M, 6C, 6K which are roller type primary transfer members as primary transfer portions are provided at positions opposing to the photosensitive members 1Y, 1M, 1C, 1K, respectively. Each primary transfer roller 6 is urged toward the photosensitive member 1 through the intermediary transfer belt 7 to form a primary transfer portion N1 at the contact portion between the photosensitive member 1 and the intermediary transfer belt 7. At an outer peripheral surface side of the intermediary transfer belt 7, a secondary transfer roller, which is a roller type secondary transfer member as a secondary transfer portion, is provided at the position opposing to a secondary transfer opposing roller which is one of the stretching rollers. The secondary transfer roller 8 is urged toward the secondary transfer opposing roller through the intermediary transfer belt 7 to form a secondary transfer portion N2 at the contact portion between the intermediary transfer belt 7 and the secondary transfer roller 8. In addition, at the outer peripheral surface of the intermediary transfer belt 51, an intermediary transfer belt cleaning device 71 as an intermediary transfer member cleaning means is provided.

In this embodiment, the photosensitive member 1, the charging roller 2, developing device 4 and the photosensitive member cleaning device 5 which are process means acting on the photosensitive member 1 are integrated by a frame into a process cartridge 30 as a unit detachably mountable to a main assembly B of the image forming apparatus A. In this embodiment, the process cartridge 30 is an exchangeable image forming unit including the charging member and detachably mountable to the main assembly B (exchanging unit).

The image forming apparatus A further comprises a recording material supplying device 10 including a recording material accommodating portion (cassette) for supplying a recording material P such as paper or an OHP sheet to the secondary transfer portion N2, and a fixing device 9 as a fixing portion provided downstream of the secondary transfer portion N2 with respect to a feeding direction of the recording material P.

The image forming apparatus A further comprises temperature/humidity sensors 11*a*, 11*b*, 11*c* and 12 which are temperature detecting portions which will be described hereinafter.

During the image forming operation, the surface of the rotating photosensitive member 1 is uniformly charged by the charging roller 2. The charged surface of the photosensitive member 1 is exposed to a scanning laser beam L in accordance with an image signal, by the exposure device 3. By this, the electrostatic image (electrostatic latent image) is formed on the photosensitive member 1. The electrostatic image formed on the photosensitive member 1 is developed by the developing device 4, using the toner. Thereafter, the toner image formed on the photosensitive member 1 is transferred electrostatically (primary-transfer) onto the intermediary transfer belt 7 by the primary transfer roller 6 in the primary transfer portion N1.

In the case of the formation of the full-color image, for example, the toner images on the four photosensitive members 1Y, 1M, 1C and 1K are transferred (primary-transfer) superimposedly onto the intermediary transfer belt 7 by the primary transfer rollers 6Y, 6M, 6C, 6K.

Thereafter, the toner image transferred onto the intermediary transfer belt 7 is electrostatically transferred (secondary-transfer) onto the recording material P fed from the recording material supplying device 10, by the secondary transfer roller 8.

The toner (primary-untransferred toner) remaining on the photosensitive member 1 after the primary-image transfer is removed by the photosensitive member cleaning device 5 and is collected. The toner (secondary-untransferred toner) remaining on the intermediary transfer belt 7 after the secondary-transfer is removed by the intermediary transfer belt cleaning device 71 and is collected.

The recording material P having the transferred toner image is heated and pressed by the fixing device 9 so that the toner image thereon is fixed. Thereafter, the recording material P is discharged to an outside of the main assembly B.

2. Image Bearing Member

In this embodiment, the image forming apparatus A comprises the rotatable drum type electrophotographic photosensitive member (photosensitive member) 1 as the image bearing member.

In this embodiment, the photosensitive member 1 includes a photosensitive layer of a negative charging property OPC (organic photo-semiconductor). The photosensitive member 1 has a diameter of 30 mm and a length of 370 mm measured in the rotational axis direction thereof. The photosensitive member 1 is rotated at the process speed of 348 mm/sec about the axis of the drum.

Figure 2:
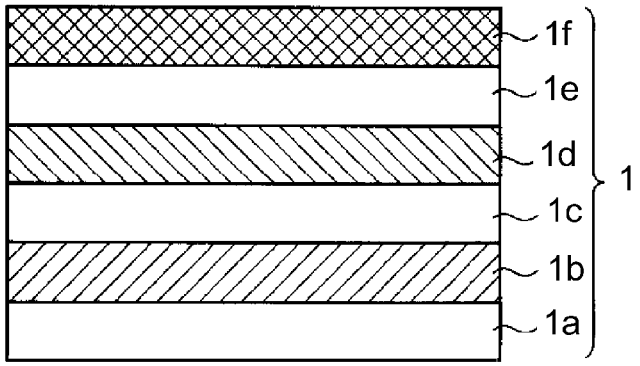
FIG. 2 is a schematic view of an example of a layer structure of a photosensitive member.

In this embodiment, the photosensitive member 1 has a layer structure of an ordinary organic photosensitive member as shown in FIG. 2. More specifically, the photosensitive member 1 includes an inside aluminum cylinder 1*a* which is an electroconductive base. On the cylinder 1*a*, there is provided an undercoat layer to suppress interference of light attributable to unsmoothness of the cylinder 1*a* and objection to transportation of the charge producer in an upper layer. On the undercoat layer 1*b*, there is provided an injection blocking layer 1*c* for permitting passage of only the electrons and for suppressing the passage of the holes produced in the upper charge generation layer 1*d*. On the injection blocking layer, there is provided a charge generation layer for generating charge by light projection. On the charge generation layer, there is provided a charge transfer layer 1*e* for transporting the charge. On the charge transfer layer 1*e*, there is provided a surface protection layer to improve the cleaning property.

The surface protection layer used in this embodiment has been produced by curing by irradiation of electron beam. By the curing, high durability is provided, but on the other hand, beating, everting and problem in the scraping of the cleaning blade of the photosensitive member cleaning device 5 tend to arise. In this embodiment, in order to suppress such problems, a universal hardness (HU) of the peripheral surface of the photosensitive member 1 is made not less than 150 N/m^2. By doing so, the cleaning property can be maintained in the repeated use. In this embodiment, the universal hardness (HU) of the peripheral surface of the photosensitive member is not less than 150 N/m^2 and not more than 220 N/m^2.

The universal hardness (HU) of the peripheral surface of the photosensitive member is measured under the ambient condition of 25 degree C. and 50%, using a hardness measuring device Fischerscope H100V (available from Fischer). With this device, an indenter is contacted to a measuring object (peripheral surface of the photosensitive member 1), and a load is continuously applied to the indenter, and the depth of indent is directly measured, so that the hardness can be measured continuously. In this embodiment, the used indenter is a Vickers quadrangular pyramid diamond indenter having a facing angle of 136°, and a final load of the continuous load is 6 mN, in which the final load state is kept for 0.1. The number of measurement points is 273.

The universal hardness (HU) is calculated as follows:

$$HU = \frac{F_f[N]}{S_f[\mathrm{mm}^2]} = \frac{6\times10^{-3}}{26.43\times(h_f\times10^{-3})^2}$$

where Ff is the final load, Sf is a surface area of the indent by the indenter when the final load is applied, and hf is the depth of the indent by the indenter when the final load is applied.

3. Charge Portion:

In this embodiment, the image forming apparatus A comprises the charging roller 2 as the charging member (contact charging member) for contacting and charging the peripheral surface of the photosensitive member 1.

Figure 3:
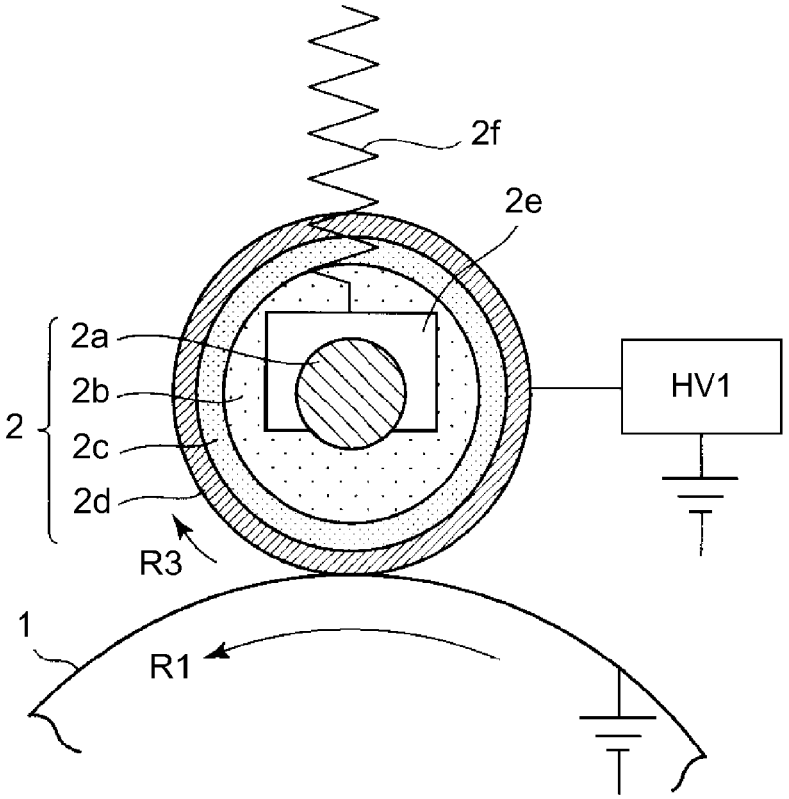
FIG. 3 is a schematic view of a voltage application system for a charging member.

As shown in FIG. 3, the charging roller 2 is rotatably supported by bearing members 2*e* at the opposite end portions with respect to the longitudinal direction (rotational axis direction) of the core metal (supporting member) 2*a*, and is urged toward the photosensitive member 1 by an urging spring 2*f* as an urging means. By this, the charging roller 2 is pressed against the surface of the photosensitive member 1 at a predetermined urging force. The charging roller 2 is rotated by the rotation of the photosensitive member 1 in a direction indicated by an arrow R3 in the Figure (clockwise). A press-contact portion between the photosensitive member 1 and the charging roller 2 is a charging nip. The charging roller 2 is contacted to the surface of the photosensitive member 1 which is the member to be charged, and is supplied with a charging bias voltage (charging voltage). By doing so, the photosensitive member 1 is charged by the discharge produced in the fine gap between the charging roller 2 and the photosensitive member 1. The fine gap effecting the charging is one or both of wedge shape spaces (configuration as seen in the direction along the rotational axis of the photosensitive member 1) in the upstream and downstream sides of the charging nip in the moving direction of the surface of the photosensitive member 1. The position or positions of the upstream side and downstream side gaps where the charging is mainly effected for the photosensitive member 1 are determined depending on various settings of the dimensions, electrical resistances and so on of the photosensitive member 1 and/or the charging roller 2, and the present invention is applicable irrespective of the settings.

In this embodiment, the length of the charging roller 2 measured in the longitudinal direction (rotational axis direction) is 330 mm, and the diameter thereof is 14 mm. As shown in the schematic view of layer structure of FIG. 3, the charging roller 2 has a three layer structure including a lower layer 2*b* on the outer periphery of the core metal, an intermediary layer 2*c* thereon and a surface layer 2*d* thereon. The core metal 2*a* is a round bar of stainless steel having a diameter of 6 mm. The lower layer 2*b* is an electronic electroconductive layer of carbon dispersed EPDM (ethylene-propylene-diene-rubber) foam, and a density thereof is 0.5 g/cm^3, the volume resistivity thereof is 10^7-10^9Ω cm, and the layer thickness is approx. 3.5 mm. The intermediary layer 2*c* is made of carbon dispersed NBR (nitrile rubber), and the volume resistivity thereof is 10^2-10^5 Ωcm, and the layer thickness is approx. 500 μm. The surface layer 2*d* is an ion electroconductive layer of alcohol soluble Nylon resin material (a fluorine chemical compound) in which tin oxide and carbon are disposed, and the volume resistivity thereof is 10^7-10^10 Ωcm, the surface roughness (10 point average surface roughness Rz under JIS) is 1.5 μm, and the layer thickness is approx. 5 μm.

In this embodiment, the voltage source HV1 as a charging bias voltage applying portion for the charging roller 2 includes a DC voltage generating portion (DC voltage source) and an AC voltage generating portion (AC voltage source). In this embodiment, the charging roller 2 charges the surface of the rotating photosensitive member 1 to a predetermined potential of negative polarity, by being supplied with a charging bias voltage from the voltage source HV1. Specific charging voltage control system will be described in detail hereinafter.

4. Exposed Portion:

In this embodiment, the image forming apparatus A includes the exposure device 3 which is a laser beam scanner using a semiconductor laser as an exposed portion (information writing means) for forming an electrostatic image on the surface of the photosensitive member 1 having been subjected to the charging. The exposure device 3 produces a laser beam modulated in accordance with the image signal supplied to the printer station including an image forming station S, from a host processing device such as an image reading apparatus (unshown). It effects the laser scanning exposure of the surface of the rotating photosensitive member 1 having been subjected to the uniform charging, in the exposed portion (exposure position). An absolute value of the potential of the portion of the surface of the photosensitive member 1 exposed to the laser beam is lowered by the laser scanning exposure, so that an electrostatic image is sequentially formed corresponding to the image information on the surface of the rotating photosensitive member 1. In this embodiment, the image portion of the image is the exposed portion.

5. Developing Portion:

In this embodiment, the image forming apparatus A includes the developing device 4 as the developing portion for supplying the toner onto the photosensitive member 1 in accordance with the electrostatic latent image on the photosensitive member 1 to develop the electrostatic image into a toner image (developer image). In this embodiment, the developing device 4 develops the electrostatic image by a reverse development in which the toner charged to the same polarity as the charge polarity (negative polarity in this embodiment) of the photosensitive member 1 is deposited onto the image portion (exposed portion) where the absolute value of the potential by the exposure after the uniform charging is changed.

In this embodiment, the developing device 4 is a two component contact-type developing system developing device in which a magnetic brush containing two component developer comprising toner and carrier is contacted to the photosensitive member 1 to effect the development. The developing device 4 includes a developing container 42 and a non-magnetic developing sleeve 41 as a developer carrying member. The outer peripheral surface of the developing sleeve 41 is partly exposed to the outside of the developing device 4 and is rotatably supported in the developing container 42. In the developing sleeve 41, a magnet roller (unshown) as a magnetic field generating means is provided non-rotatably at a fixed position. Opposed to the developing sleeve 41, there is provided a developer coating blade (unshown) as a developer regulating means.

The developing container 42 contains the two component developer and is provided in the bottom portion side with a developer stirring member (unshown). A supply of the toner is accommodated in a toner hopper (unshown). The two component developer (developer) in the developing container 42 is a mixture mainly comprising non-magnetic toner and magnetic carrier, and is stirred by the developer stirring member. In this embodiment, the magnetic carrier has a volume resistivity of approx. 10^13 Ωcm and a particle size of approx. 40 μm.

The particle size is a volume average particle size and is determined by measuring the particle sizes in the range of 0.5-350 μm with 32 logarithmic division and calculating 50% (by volume) median size as the particle size.

In this embodiment, the toner is triboelectrically charged to a negative polarity by rubbing with the magnetic carrier. The developing sleeve 41 is disposed opposed to the photosensitive member 1 with a closest distance (S-Dgap) of 350 μm. The opposing portion between the photosensitive member 1 and the developing sleeve 41 is the developing portion (developing position). In this embodiment, the developing sleeve 41 is rotated in the direction opposite the peripheral advancing direction of the photosensitive member 1 in the development position. By the magnetic force of the magnet roller in the developing sleeve 41, a part of the two component developer in the developing container 42 is attracted and kept on the outer peripheral surface of the developing sleeve 41 as a magnetic brush layer. The magnetic brush layer is fed by the rotation of the developing sleeve 41 and is regulated by the developer coating blade into a predetermined thin layer, and then in the development position, it contacts the surface of the photosensitive member 1 and properly rubs the surface of the photosensitive member 1.

The developing sleeve 41 is supplied with a predetermined developing bias voltage. In this embodiment, a developing bias voltage applied to the developing sleeve 41 is an oscillating voltage comprising the DC voltage (Vdc) and the AC voltage (Vac). More specifically, when the potential of the charged portion of the photosensitive member 1 is −700V in the developing portion, the developing bias voltage is the oscillating voltage comprising a DC voltage of −600V and a rectangular wave AC voltage having a frequency of 10.0 kHz and a peak-to-peak voltage of 1.3 kV.

The toner in the developer coated on the surface of the rotating developing sleeve 41 in the form of the thin layer and carried to the development position is deposited selectively onto the surface of the photosensitive member 1 corresponding to the electrostatic image, by the electric field provided by the developing bias voltage, so that the electrostatic latent image is developed into a toner image.

In this embodiment, the toner deposited onto the exposed portion (light portion) of the surface of the photosensitive member 1, that is, the electrostatic latent image is reversely developed. At this time, a charge amount of the toner of the developed image on the photosensitive member 1 is approx. −25 μC/g under the ambient condition of the temperature of 23 degree C. and the absolute water content of 10.6 g/m^3. The thin layer of the developer on the developing sleeve 41 having passed the development position is returned to a developer stagnation portion in the developing container 42 with the continuing rotation of the developing sleeve 41.

In order to maintain the toner content in the two component developer in the developing container 42 within a predetermined range, the following control is carried out. For example, the toner content (ratio of the toner in the two component developer) is detected by an optical toner density sensor, for example, and in accordance with the detected information, the operation of the toner hopper is controlled so that the toner in the toner hopper it is supplied into the two component developer in the developing container 42. The toner supplied to the two component developer is stirred by a stirring member.

6. Transfer Portion:

In this embodiment, the image forming apparatus A includes the transferring device 70 as the transfer portion for transferring the toner image onto the recording material P. In this embodiment, the transferring device 70 is of an intermediary transfer type using the primary transfer roller 6, the intermediary transfer belt 7 and the secondary transfer roller 8.

The primary transfer roller 6 is press-contacted to the photosensitive member 1 at a predetermined urging force to constitute a press-contact nip between the intermediary transfer belt 7 and the photosensitive member 1 as the primary transfer portion N1. The secondary transfer roller 8 is press-contacted to the intermediary transfer belt 7 at a predetermined urging force to constitute a press-contact nip between the intermediary transfer belt 7 and the secondary transfer roller 8 as the secondary transfer portion N2. The toner image transferred onto the intermediary transfer belt 7 is transferred onto the recording material P which is being fed by the nip between the intermediary transfer belt 7 and the secondary transfer roller 8 at the predetermined control timing from the recording material supplying device 10.

The primary transfer roller 6 is supplied from the voltage source (unshown) with a primary transfer bias of the positive polarity which is opposite the regular charge polarity of the toner (negative polarity), the primary transfer bias being a DC voltage of +1200V in this embodiment. By this, the toner image on the surface of the photosensitive member 1 is electrostatically transferred onto the intermediary transfer belt 7 gradually. The secondary transfer roller 8 is supplied from the voltage source (unshown) with a secondary transfer bias voltage of the positive polarity which is opposite the regular charge polarity of the toner (negative polarity), the secondary transfer bias voltage being a DC voltage of +3000V in this embodiment. By this, the toner image on the intermediary transfer belt 7 is electrostatically transferred onto the recording material P gradually.

7. Fixing Portion:

In this embodiment, the image forming apparatus A includes the fixing device 9 as a fixing portion, the fixing device 9 heating and pressing the toner image to fix it on the recording material P.

The recording material P having received the toner image through the secondary transfer portion N2 is fed into the fixing device 9. In this embodiment, the fixing device 9 is a heat roller fixing device, and includes a pair of fixing rollers having heating sources and press-contacted to each other. The fixing device 9 effects a fixing process to fix the toner image on the recording material P, and the recording material P is discharged as a print or copy.

8. Photosensitive Member Cleaning Means:

In this embodiment, the image forming apparatus A includes the photosensitive member cleaning device 5 as the photosensitive member cleaning means for removing the toner from the photosensitive member 1 using a cleaning blade 51 as the cleaning member.

The toner remaining on the surface of the photosensitive member 1 after the toner image has been transferred onto the intermediary transfer member 7 in the primary transfer portion N1 (primary-untransferred toner) is removed from the surface of the rotating photosensitive member 1 by the cleaning blade 51 and is collected into a collection container 52.

9. Temperature Detecting Portion:

The image forming apparatus A of this embodiment includes first, second, third and fourth temperature/humidity sensors 11*a*, 11*b*, 11*c* and 12 which are temperature detecting portions as the ambient condition detecting means.

Among them, the first, second and third temperature/humidity sensors 11*a* 11*b*, 11*c* constituting an apparatus-inside temperature/humidity sensor (first temperature detecting portion) 110 which will be described hereinafter are provided inside the main assembly B of the image forming apparatus A to detect the ambient condition inside the main assembly B (apparatus-inside) of the image forming apparatus A. The first, second and third temperature/humidity sensors 11*a*, 11*b*, 11*c* acquire the temperature/humidity information in the neighborhood food of the image forming stations SY, SM, SC, Sk, respectively. It is preferable to dispose the first, second and third temperature/humidity sensors 11*a*, 11*b* and 11*c* adjacent to the respective image forming stations SY, SM, SC and Sk, and it is further preferable to dispose them adjacent to the respective charging rollers 2 from the standpoint of enhancing the accuracy of the charging voltage control, which will be described hereinafter.

As shown in FIG. 1, in this embodiment, three temperature/humidity detecting means (first, second and third temperature/humidity sensors 11*a*, 11*b* and 11*c*) are provided. That is, the first, second and third temperature/humidity sensors 11*a*, 11*b* and 11*c* are disposed adjacent to the first and second image forming stations SY and SM, adjacent to the second and third image forming stations SM and SC, and adjacent to the third and fourth image forming stations SC and SK, respectively. The first temperature/humidity sensor 11*a* detects the temperature/humidity information of the charging roller 2Y of the first image forming station SY. The first and second temperature/humidity sensors 11*a* and 11*b* detect the temperature/humidity information of the charging roller 2M of the second image forming station SM. The second and third temperature/humidity sensors 11*b* and 11*c* detect the temperature/humidity information of the charging roller 2C of the third image forming station SC. The third temperature/humidity sensor 11*c* detects the temperature/humidity information of the charging roller 2K of the fourth image forming station SK. In this embodiment, for the charging rollers 2M and 2C of the second third image forming stations SM and SC, an average of detection results of the two temperature/humidity detecting means are used.

In this embodiment, three temperature/humidity detecting means are employed in order to acquire inside temperature/ humidity information in the main assembly B, but this structure is not inevitable, and the sensors as may be provided for the respective image forming stations (respective charging members). With respect to a structure using exchanging units, the sensors may be provided at the respective positions opposing to the position where the exchanging unit is mounted inside the image forming apparatus, by which the temperatures of the exchanging unit can be correctly detected.

A fourth temperature/humidity detecting sensor 12 which is an apparatus-outside temperature/humidity sensor (second temperature detecting portion 111 which will be described hereinafter) is provided adjacent to the recording material supplying device 10 in this embodiment to detect the ambient condition where the image forming apparatus A is installed. By doing so, the fourth temperature/humidity sensor 12 acquires the temperature/humidity information different from the information inside the main assembly B of the image forming apparatus A. In the apparatus of this embodiment, the main assembly B and the recording material supplying device 10 such as a recording material accommodating portion are provided in different casings (frames), and they are connected with each other. More particularly, the main assembly B is accommodated in a first casing, and the recording material supplying device 10 such as the recording material accommodating portion is accommodated in a second casing, wherein the apparatus-inside temperature/humidity sensor 110 as the first temperature detecting portion is disposed inside the first casing, and the apparatus-outside temperature/humidity sensor 111 as the second temperature detecting portion is disposed inside the second casing. Therefore, the temperature/humidity detecting means provided in the recording material supplying device 10 is relatively less influenced by the heat source of the fixing device 9 and so on provided in the main assembly B and provides the temperature/humidity information which is different from that provided by the temperature/humidity detecting means placed in main assembly B and which is close or equivalent to the installed ambient condition of the image forming apparatus corresponding to the ambient condition outside the main assembly B.

Alternatively, the use can be made with an external information terminal as the temperature/humidity detecting means to acquire temperature/humidity information different from the information of the inside the main assembly B.

The temperature/humidity information acquired by the first, second, third and fourth temperature/humidity sensors 11*a*, 11*b*, 11*c* and 12 are collected in a printer controller 105, and is used as determination factors for the charging voltage set condition, as will be described in detail hereinafter referring to FIG. 6. The first, second and third temperature/humidity sensors constitute the apparatus-inside temperature sensor 110 in FIG. 6, and the fourth temperature/humidity sensor 12 constitutes the apparatus-outside temperature/humidity sensor 111 in FIG. 6.

Figure 4:
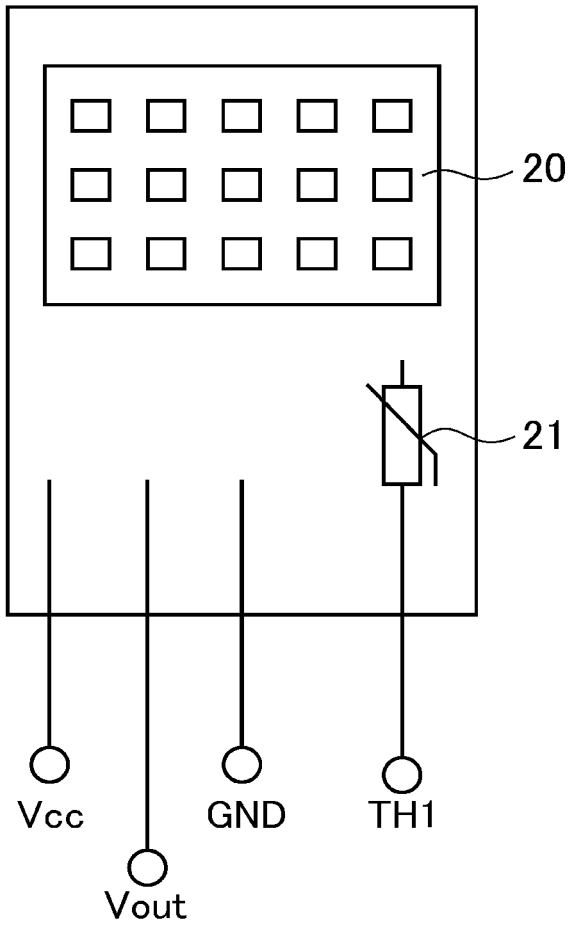
FIG. 4 is a schematic view of an example of a temperature/humidity detecting means.

As shown in FIG. 4, in this embodiment, the first, second, third and fourth temperature/humidity sensors 11*a*, 11*b*, 11*c* and 12 comprises a humidity detecting portion 20 as the humidity detecting means, and a temperature detecting portion 21 as a temperature detecting means. In this embodiment, the humidity detecting portion 20 is a polymeric resistance change type sensor HIS-06H-N available from HDK, and the temperature detecting portion 21 is a chip thermistor available from Kabushiki Kaisha Ohizumi Seisakusho. The humidity detecting portion 20 and the temperature detecting portion 21 are connected with respective voltage source contacts Vcc, output terminals Vout, ground contacts GND, and thermistor contacts TH1.

The humidity detecting means and the temperature detecting means and not necessarily those of this embodiment, and other humidity sensor, temperature sensor or temperature/humidity sensor may be usable individually or in combination.

10. Charging Voltage Control:

The charging voltage control in this embodiment will be described. The structures and operations of the charging voltage control are substantially the same among the charging rollers 2Y, 2M, 2C and 2K of the image forming stations SY, SM, SC and SK.

Figure 5:
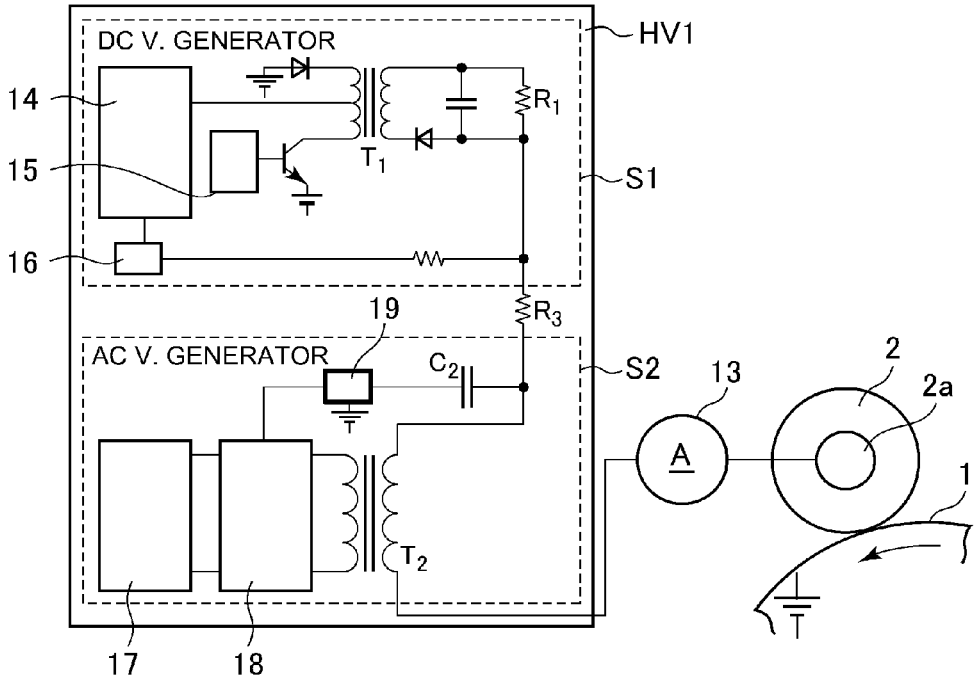
FIG. 5 is a circuit diagram of an example of a high voltage source circuit for supplying a charging bias voltage.

FIG. 5 is a schematic circuit diagram of a charging bias voltage application system for the charging roller 2 in this embodiment. As shown in FIG. 5, the voltage source HV1 as the applying portion for applying the charging bias voltage to the charging roller 2 includes the DC voltage generating portion (DC voltage source) S1 and the AC voltage generating portion (AC) S2.

The DC voltage is constant voltage outputted from the DC voltage source S1 including a transformer T1. In the DC voltage source, the DC high voltage control circuit (comparator) 14 detects the DC voltage through the resistance R1 by a voltage detecting circuit 16, and stabilizes the DC voltage output on the basis of the output information thereof. A control circuit driving signal input portion 15 inputs a driving signal to the transformer. The AC voltage is constant current outputted from the AC voltage source S2 including the transformer T2. An AC high voltage control circuit 17 detects an AC current through a capacitor C2 by a current detecting circuit 19, and controls a gain of an amplification circuit 18 on the basis of the output information thereof. The output of the DC voltage source S1 and the output of the AC voltage source are superimposed with each other through the resistor R3.

The predetermined oscillating voltage (charging bias voltage Vdc+Vac) in the form of superimposed DC voltage and AC voltage having a frequency f is applied to the charging roller 2 through the core metal 2*a*. By this, the peripheral surface of the rotating photosensitive member 1 is electrically charged to the predetermined potential.

A current measurement circuit 13 for measuring the DC current and the AC current floating through the charging roller 2 through the photosensitive member 1 is connected between the voltage source HV1 and the charging roller 2. From the current measurement circuit 13, the acquired information of the current is inputted to the printer controller 105 which will be described hereinafter in conjunction with FIG. 6.

Figure 6:
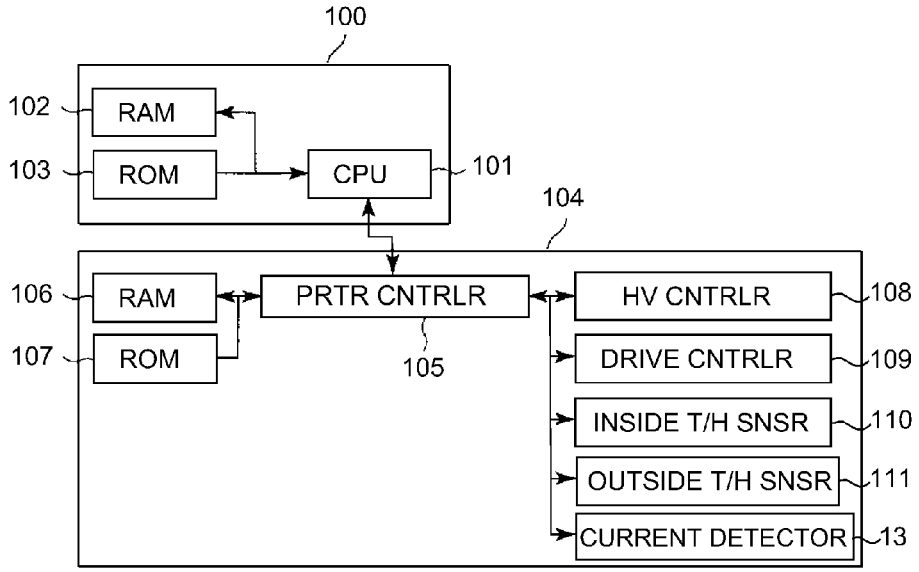
FIG. 6 is a schematic control block diagram of an example of an image forming apparatus.

The printer controller 105 in FIG. 6 inputs set point signals for controlling the outputs of the DC high voltage control circuit 14 and the AC high voltage control circuit 17 constituting a high voltage controller 108 in FIG. 6. By this, the printer controller 105 is provided with functions of controlling the DC voltage value applied to the charging roller 2 from the DC voltage source S1 and controlling the peak-to-peak voltage or AC current of the AC voltage applied to the charging roller 2 from the AC voltage source S2.

The printer controller 105 has a function of executing a calculation and determination program for a charging bias voltage applied to the charging roller 2 in the charging step in the printing (image formation) operation, on the basis of the information of the current supplied from the current measurement circuit 13.

11. Control Method:

The control method for the image forming apparatus A will be described. FIG. 6 is a hardware block diagram explaining a connection relationship between the CPU (central processing device) 101 as the controlling means for controlling overall operations of the image forming apparatus A of this embodiment and various parts.

The image forming apparatus A is controlled by a controller 100 for managing jobs and a printer controller 104 for controlling the printer station including the image forming stations S for forming a visualized image on the recording material P from the image data. Here, the job is a series of image forming operations for a single or multiple recording materials in response to starting instructions of one image forming operation.

The controller 100 includes the CPU101, a ROM 103 as a storing means in which a control program is written, and a RAM 102 as a storing means for storing data for executing the process. They are connected with each other by bus so that they can interchange information mutually.

The printer controller 104 controls the image forming stations S of the printer station to effect the basic control of the image forming operation. The printer controller 104 includes a printer controller 105 functioning controlling means, a ROM 107 as the storing means in which a control program is written, a RAM 106 as the storing means for storing data for effecting the process of the image forming operation. They are connected with each other by bus so that they can communicate with each other. Here, the ROM 107 stores a program for the operation flow for executing the charging voltage setting.

The printer controller 104 includes a device controller 108-111 provided with an I/O port or the like for controlling each constituent element of the printer station. The device controller includes the high voltage controller 108 for controlling the high voltage and the drive controlling portion 109. It also includes the apparatus-inside temperature/humidity sensor 110 for detecting the temperature/humidity in the image forming apparatus, and the apparatus-outside temperature/humidity sensor 111 for detecting temperature/humidity of the installed ambient condition of the image forming apparatus.

Figure 7:
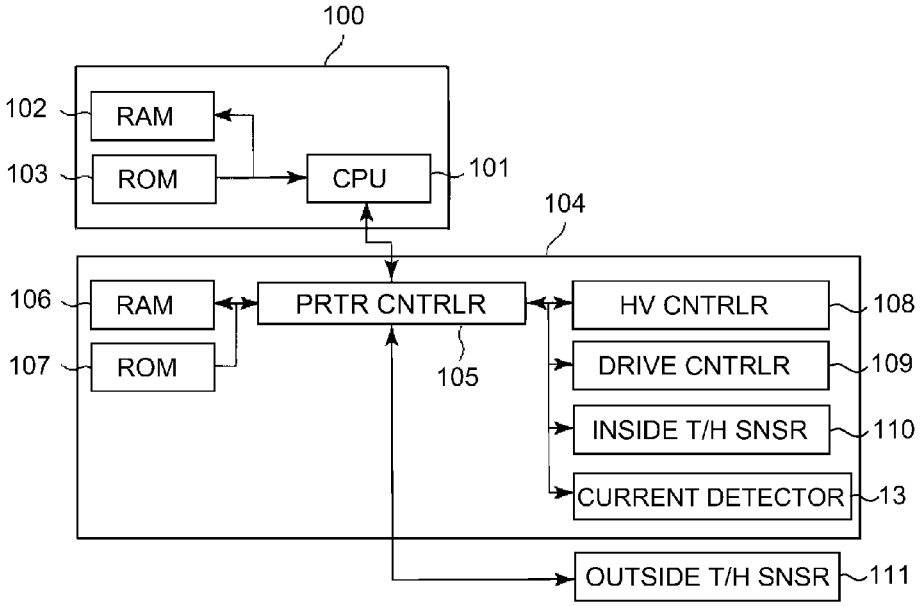
FIG. 7 is a schematic control block diagram of an example of the image forming apparatus.

In this embodiment, the apparatus-outside temperature/humidity sensor 111 is provided in the printer controller 104, but as shown in FIG. 7, the information may be supplied to the printer controller 105 through bi-directional communication using an external interface.

Comparison Example 1

A first comparison example 1 of the charging voltage control relating to the image forming apparatus A of this embodiment will be described. In this comparison example, the charging voltage control is carried out using the apparatus-inside temperature/humidity sensor 110.

Figure 8:
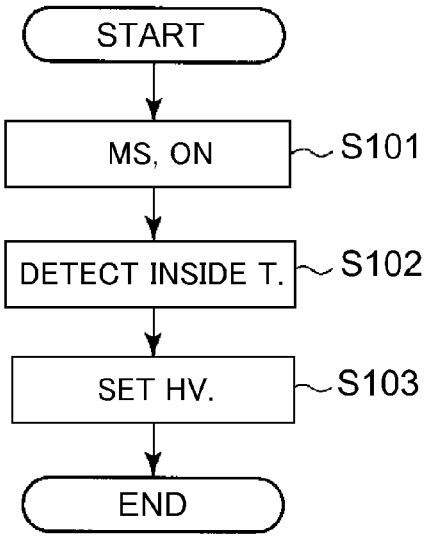
FIG. 8 is a flow chart in comparison example 1.

Referring to a flow chart of FIG. 8, the charging voltage control using the apparatus-inside temperature/humidity sensor 110 in the comparison example will be described. FIG. 8 is a flow chart of the operation to determine the charging voltage value.

The CPU101 as the controlling means controls various parts of the image forming apparatus A in accordance with the program stored in the ROM 103 as follows.

S101: the CPU101 checks whether the voltage source of the image forming apparatus A is actuated by the operator or not.

S102: the CPU101 instructs the printer controller 105 to carry out the program in the ROM 107. The printer controller 105 having received the instructions acquires the temperature/humidity information from the apparatus-inside temperature/humidity sensor 110.

S103: the printer controller 105 calculates a proper value from the acquired information using a relationship set in the ROM 107 between the temperature and the required charging AC voltage.

Figure 9:
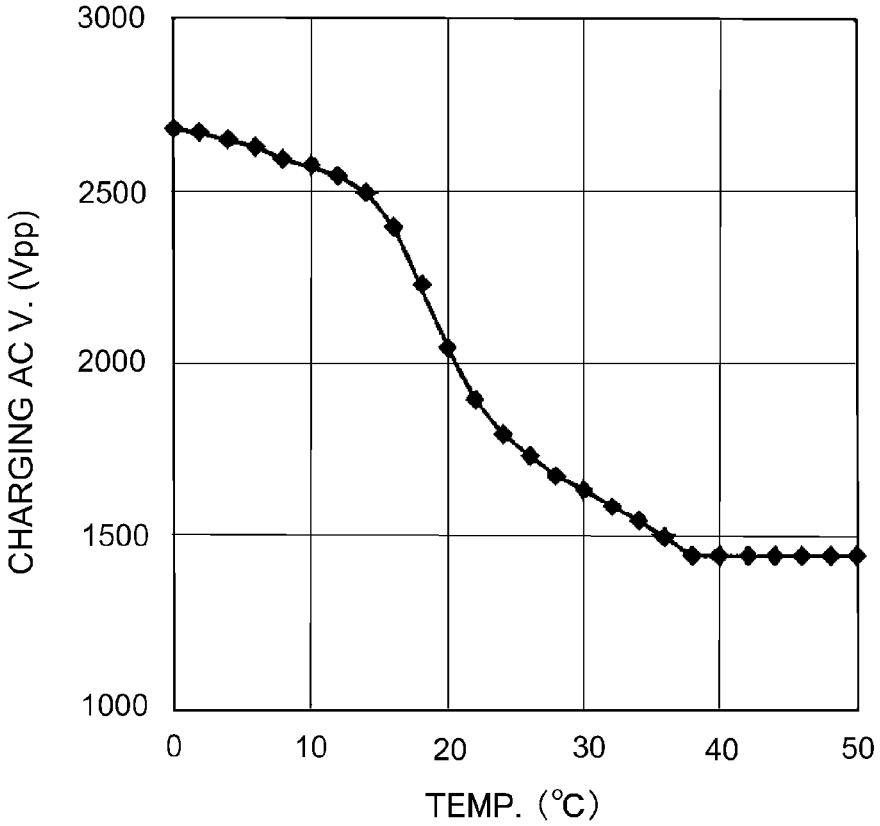
FIG. 9 is a graph of a relationship between a temperature and a charging AC voltage.

In this comparison example, the required charging AC voltage is calculated from the detection result of the apparatus-inside temperature/humidity sensor 110 using the relationship between the temperature and the charging AC voltage shown in FIG. 9. In FIG. 9, the abscissa is a temperature, and an ordinate is a required charging AC voltage.

Here, for the purpose of comparison with this comparison example, a conventional discharge current control for the control of the charging AC voltage will be described.

Figure 20:
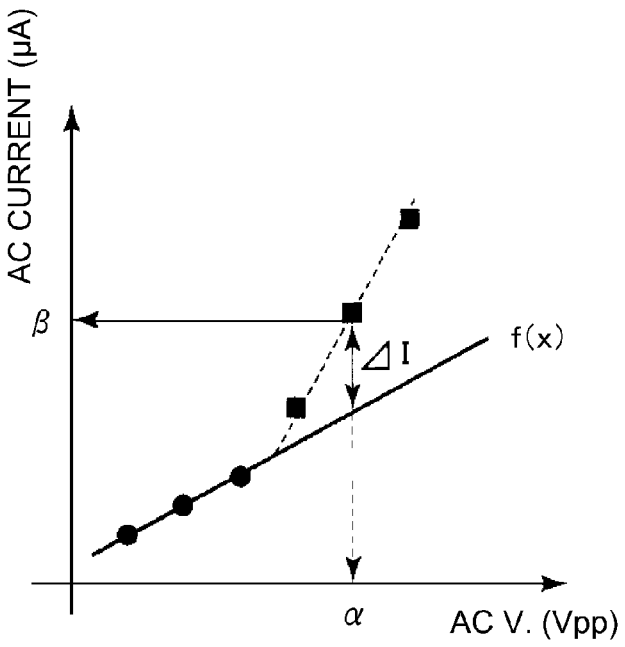
FIG. 20 is a graph showing a conventional discharge current control.

FIG. 20 shows a relationship between the charging AC voltage and the discharge current. In the discharge current control, the relationship between the AC voltage in an undischarging range based on the Paschen's law and the AC current is first approximated by a linear line using least square approximation (f(x) in the Figure). Then, the AC voltages in the discharge region are sequentially applied at predetermined intervals, and the AC currents are measured. A difference ΔI between the measured AC current in the discharge region and the AC current at the same AC voltage obtained by extrapolation of f(x) into the discharge region is calculated. This ΔI is defined as a discharge current, and the AC voltage and the AC current meeting the discharge current required in the current state are calculated.

For example, when the ΔI upon application of AC voltage α (Vpp) is the desired discharge current in FIG. 20, the current control is executed so that the AC current β (μA) is maintained.

Figure 21:
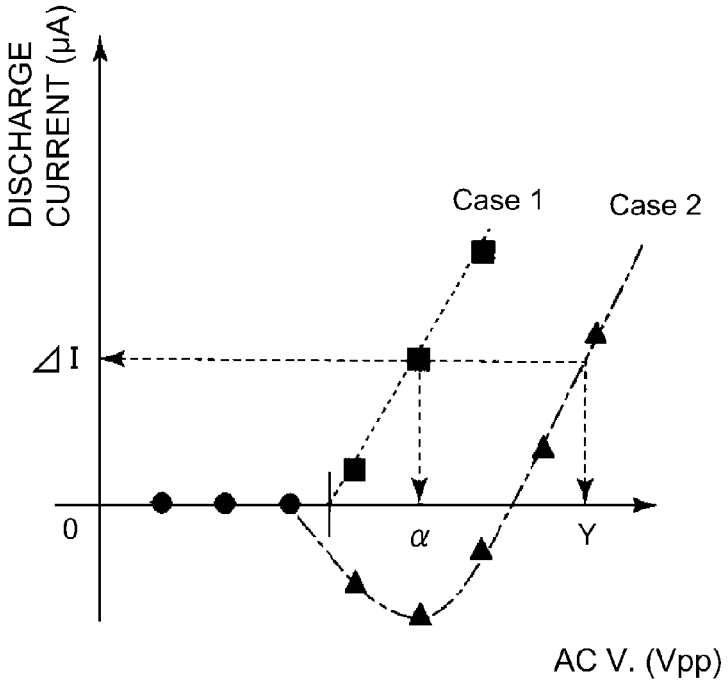
FIG. 21 is a graph for explaining a problem with a conventional structure.

FIG. 21 shows the AC voltage on the abscissa and the discharge current ΔI on the ordinate, from the results of FIG. 20. FIG. 21 shows the relationship between the discharge current and the AC voltage when the above-described problem arises.

Case 1 in FIG. 21 shows the state in the normal operation. In FIG. 21, Case 2 shows, on the other hand, an example of the control result when an abnormal operation occurs in which there is a voltage range within which the discharge current ΔI determined as the above-described difference between approximated lines is negative, although the ambient conditions are the same. It will be understood from FIG. 21 that the calculated AC voltages as required to set the same discharge current ΔI are different from each other.

With the conventional charging member such as a charging roller, even if the discharge current control operation is correct, an improper charging occurs in the case of such setting of the discharge current as results in negative discharge current in FIG. 21. Therefore, the discharge current is set at a relatively high level. For this reason, the problem of the existence of the range in which the discharge current is negative is not notable.

However, because of recent improvement in the material property of the charging member such as a charging roller, the region free of the improper charging with a low discharge current becomes wider. The use of the low discharge current range is preferable from the standpoint of reduction of the discharge damage to the photosensitive member and reduction of the accumulation of the electric discharge product. In the case of the cleaning type using an elastic material such as a blade, the reduction of the discharge current setting is preferable from the standpoint of cleaning performance maintenance for a long-term and from the standpoint of the prevention of the everting and toner slip-through. For these reasons, a stabilized control in such a low discharge current range is preferable.

With the charging roller 2 used in this comparison example, a discharge current not resulting in the improper charging can be set in the relatively low discharge current range, and therefore, the unstable control range (the region in which the discharge current is negative in the Figure) is usable. Therefore, there is likelihood that the control it is not possible because of the existence of the negative discharge current range.

The present invention is intended to make a properly charging voltage setting possible in the low discharge current range without relying on the discharge current control system.

In this comparison example, the image forming apparatus A includes the apparatus-inside temperature/humidity sensor 110 as the temperature detecting portion for detecting the information relating to the temperature. The printer controller 105 as the setting portion sets the AC voltage (peak-to-peak voltage) of the charging bias voltage for the image formation, on the basis of the temperature detection result of the apparatus-inside temperature/humidity sensor 110. Particularly, in this comparison example, the image forming apparatus A comprises a ROM 107 as a storing portion for storing information indicative of such a relationship (FIG. 9) between the temperature and the AC voltage (peak-to-peak voltage) for applying to the charging roller 2 as is set so that an AC discharge current not less than a predetermined level by which the improper charging does not occur can be provided. The printer controller 105 as the setting portion sets the AC voltage (peak-to-peak voltage) of the charging bias voltage for the image formation on the basis of the temperature detection result of the apparatus-inside temperature/humidity sensor 110 and the information stored in the ROM 107.

In this comparison example, the apparatus-inside temperature/humidity sensor 110 functions as a means capable of directly detecting the temperature/humidity information of the charging roller 2.

In this manner, according to this comparison example, the AC voltage of the charging bias voltage can be determined on the basis of the detection result of the temperature without relying on the method of measuring the discharge current in the image forming apparatus A in order to determine the charging AC voltage in the conventional discharge current control. Therefore, a single AC voltage of the charging bias voltage can be set for the same ambient condition. Therefore, the situation in which the control does not converge does not arise, and therefore, the stabilized charging voltage setting can be accomplished.

More specifically, when the temperature inside the main assembly B of the image forming apparatus A of 20 degree C., for example, is acquired, the AC voltage of the charging bias voltage is 2050 Vpp from the relationship shown in FIG. 9.

Here, the relation shown in FIG. 9 is determined on the basis of the following evaluation method.

Figure 10:
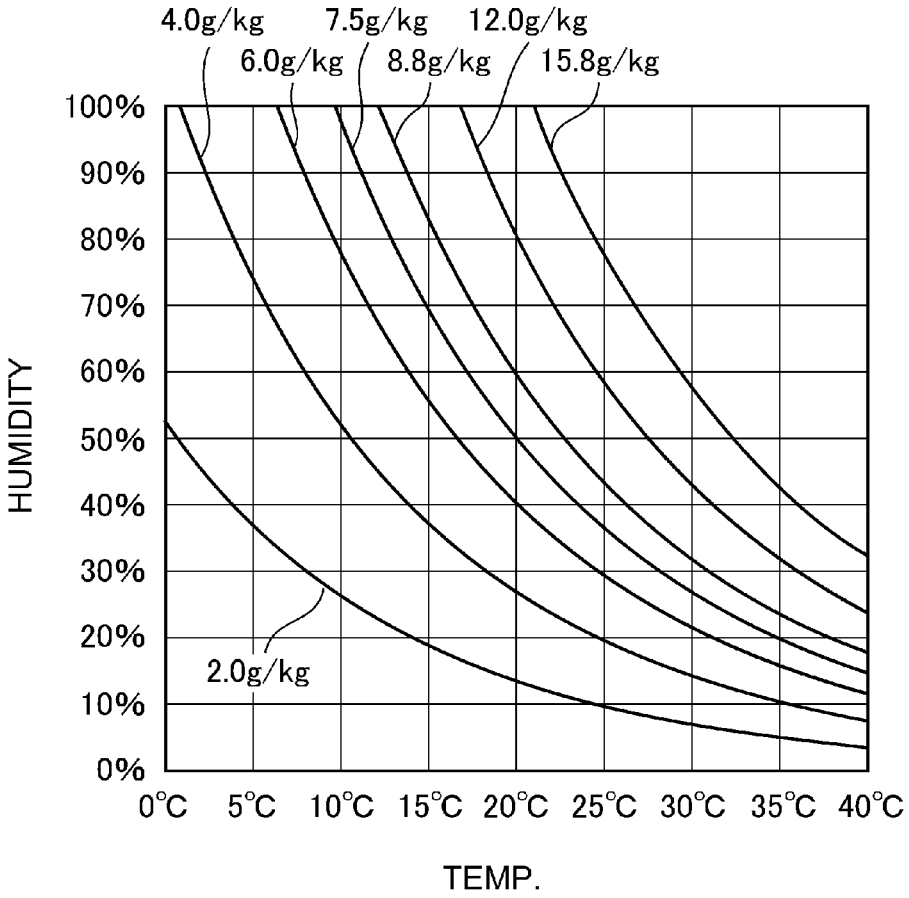
FIG. 10 is a graph showing an absolute water content calculated from a relationship between temperature and humidity.

The image forming apparatus A is installed under the ambient condition in which the humidity is controlled so as to provide the same absolute water content for the respective temperatures, after the absolute water content is calculated on the basis of the detection results of the apparatus-inside temperature/humidity sensor 110. FIG. 10 is used for setting the evaluation ambient condition, in which the abscissa is the temperature, and the ordinate is the humidity. In this Figure, the lines are isohume (absolute water content) lines, and by setting the temperature and the humidity on one of the lines, the absolute water content is the same for different temperatures, and therefore, the evaluation can be made under the same ambient condition.

The DC voltage of the charging bias voltage is −750V, and the potential of the photosensitive member 1 in the developing position is approx. −700V. The developing bias voltage is an oscillating voltage comprising a DC voltage of −600V in the rectangular wave AC voltage having a peak-to-peak voltage of 1300 Vpp and a frequency of 10.0 kHz; with these settings, no foggy background is produced on the sheet. The transferring current is set to 40 μA by which the toner image is transferred from the photosensitive member 1 onto the intermediary transfer member belt 7 in an optimum state in the primary transfer portion (primary transfer position) N1.

With such said voltage set condition under the water content controlled ambient condition, 17 tone gradation images are printed with different charging AC applied voltage conditions, and the occurrence of the improper charging on the image is evaluated (subjective evaluation).

As a result, the relationship only with the temperature as the sensitivity factor without relying on the humidity as shown in FIG. 9 can be obtained as the region not resulting in the improper charging.

As for the timing of the measurement in this comparison example, such may be carried out in real time or at regular intervals, depending on the installed ambient condition of the image forming apparatus A. By this, a high accuracy control can be carried out depending on the installed ambient condition of the image forming apparatus A. Generally speaking, the calculation and determination program for the charging AC voltage to the charging roller 2 in the charging step during the image formation is carried out during a non-image-formation period. The non-image-formation period may be as follows. In the operation, there is an initial rotating operation (multiple pre-rotation step) which is a predetermined preparing operation executed upon actuation of the voltage source of the image forming apparatus or upon a recovery from a sleeping mode, in order to raise the fixing temperature, for example. In addition, there is a printing preparation rotating operation (pre-rotation step) which is a predetermined preparing operation from input of the image formation signal to the actual printing of the image in accordance with the image information. Furthermore, there is a sheet interval period corresponding to between adjacent sheets during a continuous image formation. Moreover, there is a post-rotation step in which a predetermined post-processing (preparing operation) after completion of the image formation is executed.

Comparison Example 2

A second comparison example of the charging voltage control relating to the image forming apparatus A of this embodiment will be described.

In comparison example 1, the apparatus-inside temperature/humidity sensor 110 directly detects the temperature/humidity information of the charging roller 2. However, because of the structure of the main assembly B, the direct detection may not be possible. In such a case, an error may be involved in the temperature/humidity detection information.

Particularly if an exchange part kept outside the apparatus is mounted to the main assembly B when there is a remarkable difference between the apparatus-outside temperature and the apparatus-inside temperature, the desired discharge current is not provided with the result of improper charging due to mismatch of ambient conditions although the control operation is carried out in order.

In such a case, the conventional discharge current control may not carry out the control properly, as shown in FIG. 21. However, even in the case in which the discharge current control is not proper as in Case 2 of FIG. 21, the improper charging or the like does not occur if the value at the time of the normal operation is used. It is considered that when the control using a trigger of the ambient condition is performed, a malfunction of the control attributable to the above-described ambient condition mismatch tends to occur.

In consideration of this, the charging voltage setting is executed on the basis of calculation of a dynamic AC resistance of the charging roller 2 in this comparison example.

Figure 11:
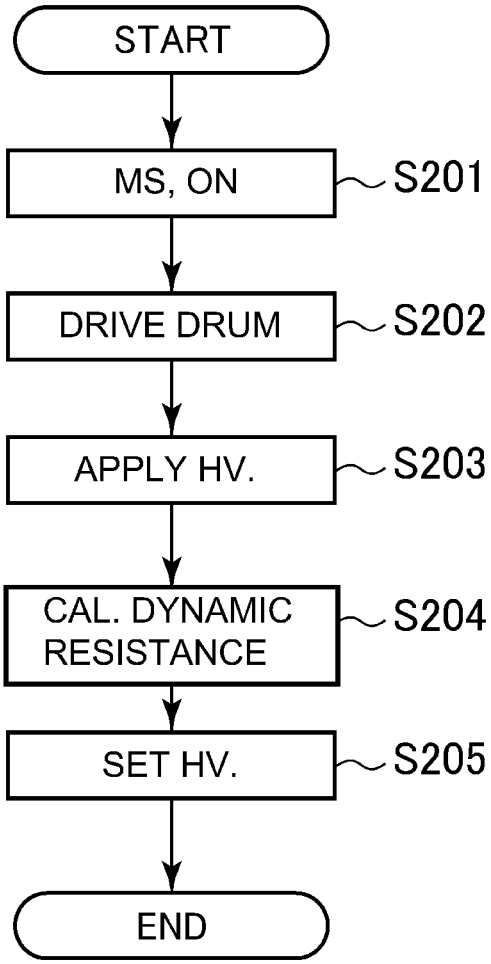
FIG. 11 is a flow chart in comparison example 1.

Referring to a flow chart of FIG. 11, the charging voltage control using a current measurement circuit 13 in this embodiment will be described. In this comparison example, the current measurement circuit 13 functions as a resistance detection means configured to detect information relating to an electric resistance of the charging roller 2. FIG. 11 is a flow chart of the operation to determine the charging voltage value.

The CPU101 as the controlling means controls various parts of the image forming apparatus A in accordance with the program stored in the ROM 103 as follows.

S201: the CPU101 checks whether the voltage source of the image forming apparatus A is actuated by the operator or not.

S202: the CPU101 instructs the printer controller 105 to carry out the program in the ROM 107. The printer controller 105 having received the instructions instructs the drive controlling portion 109 to drive the photosensitive member 1.

S203: the printer controller 105 instructs the high voltage controller 108 to apply the charging AC voltage on the basis of the program of the ROM 107.

S204: the printer controller 105 stores the value detected using the current measurement circuit 13 in the RAM 106, and calculates the dynamic AC resistance value, and the proper value is calculated using a relationship preset in the ROM 107 between the dynamic AC resistance value and the required charging AC voltage.

Figure 12:
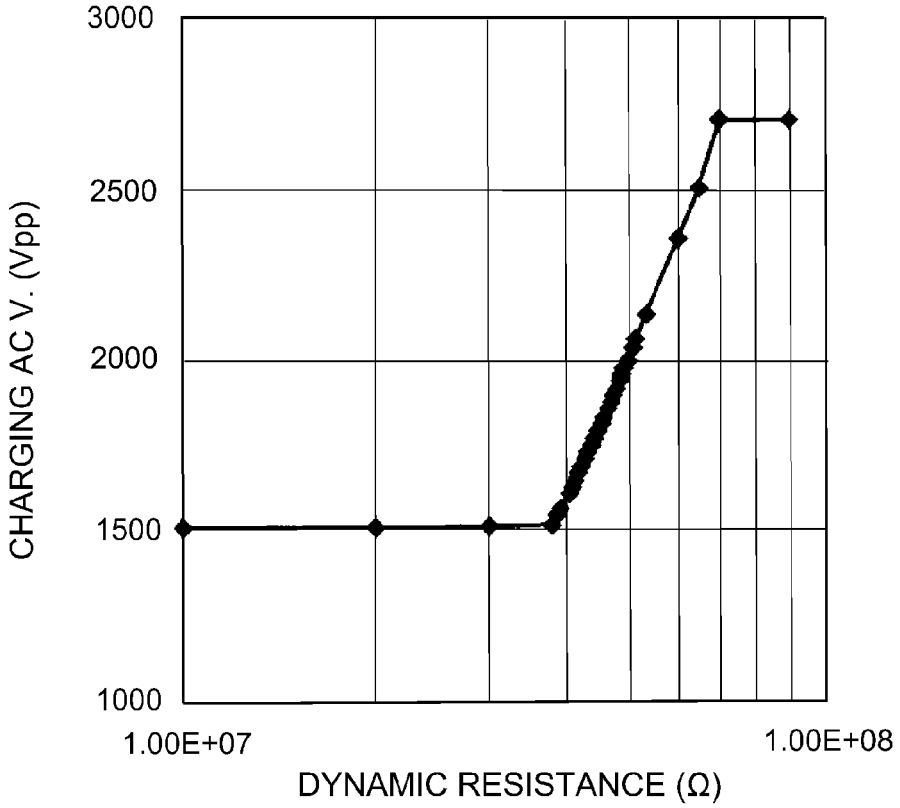
FIG. 12 is a graph of a relationship between a dynamic resistance and a charging AC voltage.

In this comparison example, the required charging AC voltage is calculated using the relationship between the dynamic resistance and the charging AC voltage as shown in FIG. 12. In FIG. 12, the abscissa is the dynamic AC resistance value, and the ordinate is the required charging AC voltage.

More specifically, when the information that the dynamic resistance is 5.0E+07Ω (5.0×10^7Ω), for example, the charging AC voltage (peak-to-peak voltage) is 2000 Vpp from the relationship of FIG. 12.

A method for measuring the dynamic AC resistance will be described.

Figure 13:
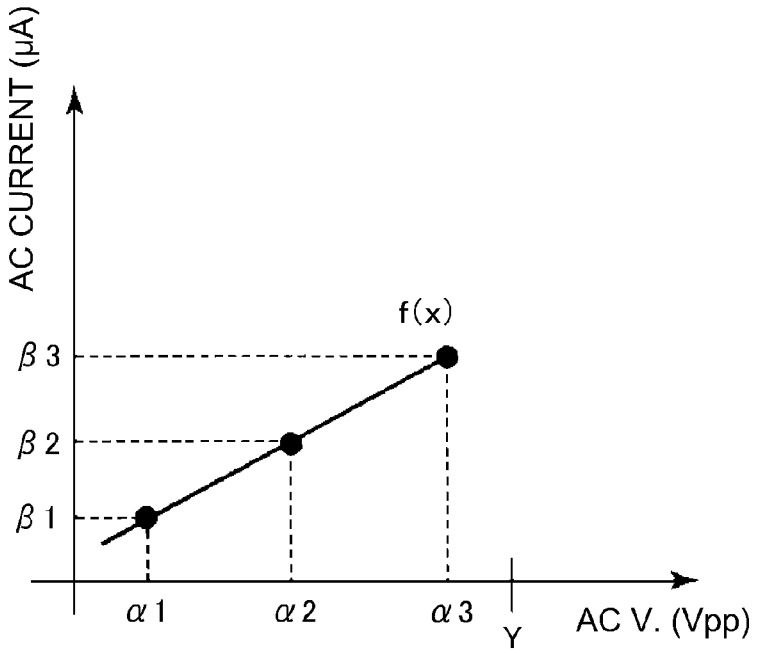
FIG. 13 is a graph showing a dynamic resistance measuring method.

FIG. 13 is a schematic diagram of a relationship between the AC voltage (abscissa) and the AC current (ordinate) at the time when a charging AC voltage in the un-discharging range is applied to the charging roller 2 at regular voltage intervals. Y in FIG. 13 depicts a discharge starting voltage to the photosensitive member 1 in this comparison example, and is determined on the basis of the Paschen's law. In a system including a gap distance Z (μm), a thickness d (μm) and a dielectric constant ∈r, the voltage Vg across the gap satisfies, $$Vg=Z/(z+d/\in r) \quad (1)$$

The gap voltage Vg and the gap distance Z satisfy the following by the Paschen's law:

$$Vg=312+6.2*z \quad (2)$$

With the gap Z, when the voltage exceeds Vg, the discharge starts, and therefore, the discharge starting voltage can be expressed by, $$Y=\sqrt{7737.6*d/\in r}+312+6.2*d/\in r \quad (3)$$

The photosensitive member 1 used in this embodiment has d=35 and ∈r=2.5, and therefore, the discharge starting voltage Y is approx. 728V. Therefore, the AC voltage in α1-α3 in FIG. 13 is set to be not more than this value.

The printer controller 105 acquires a value β1-β3 detected by the current measurement circuit 13 relative to the applied AC voltage. From the acquired value, the printer controller 105 calculates an inclination by the least square approximation and using the inclination as the dynamic AC resistance value. By doing so, the printer controller 105 can determine the charging AC voltage to be applied during the image formation from the relationship of FIG. 12.

In this comparison example, when the dynamic AC resistance value is measured, only the charging AC voltage is applied, but a predetermined DC voltage may be applied at the time of measurement if the value determined by subtraction of the DC current satisfies the relationship of FIG. 12.

Thus, the image forming apparatus A of this comparison example includes the current measurement circuit 13 as the resistance detection means for detecting the information relating to the electric resistance of the charging roller 2 by detecting the voltage and the current at the time when a voltage less than the discharge starting voltage is applied to the charging roller 2 from the voltage source. By employing an AC voltage as the voltage applied in the resistance detection as in this embodiment, the measurement is carried out under the condition close to that during the actual image forming operation, and therefore, the precision of measurement can be improved. In addition, in this comparison example, the image forming apparatus A includes the storing means ROM 107 storing the information indicative of such a relationship (FIG. 12) between the electric resistance of the charging roller and the AC voltage applied to the charging roller as set so as to provide an AC discharge current which is not less than a predetermined level. The printer controller 105 as the setting means sets the AC voltage of the charging bias voltage for the image forming operation from the resistance detection result by the current measurement circuit 13 and the information stored in the ROM 107. In this comparison example, by detecting the information relating to the electric resistance during the rotation of the photosensitive member 1, the measurement is carried out substantially under the same condition as in the actual image forming operation, except for the condition of the high voltage application, and therefore, the precision of measurement can be improved.

The measurement timing in this comparison example may be the same as with the comparison example 1. By carrying out the measurement prior to start of the job and/or at regular intervals, the accuracy of the control can be improved.

Comparison Example 3

A third comparison example of the charging voltage control relating to the image forming apparatus A of this embodiment will be described.

In this comparison example, a higher accuracy of the charging voltage setting is executed from the detection result of the apparatus-inside temperature/humidity sensor 110 and the result of determination of the dynamic AC resistance value. This comparison example is effective when the temperature/humidity condition inside the main assembly B of the image forming apparatus A and the temperature/humidity condition outside thereof are remarkably different. With the image forming apparatus A, it may be necessary to exchange an exchanging unit as a unit including the charging roller 2, such as an image forming unit, particularly a process cartridge 30. At this time, the exchanging unit may be kept in a place where the temperature/humidity condition is different from those of the inside of the main assembly B of the image forming apparatus A. Generally, the exchanging unit is often stored in a place of a temperature lower than that of the inside of the main assembly B of the image forming apparatus A. When such an exchanging unit as it is mounted to the inside of the main assembly B of the image forming apparatus A, the charging voltage setting for a high temperature state is used with the result of the improper charging in the case of the control of comparison example 1. In this comparison example, the control is carried out taking this into account, so that a better charging voltage setting is possible.

Figure 14:
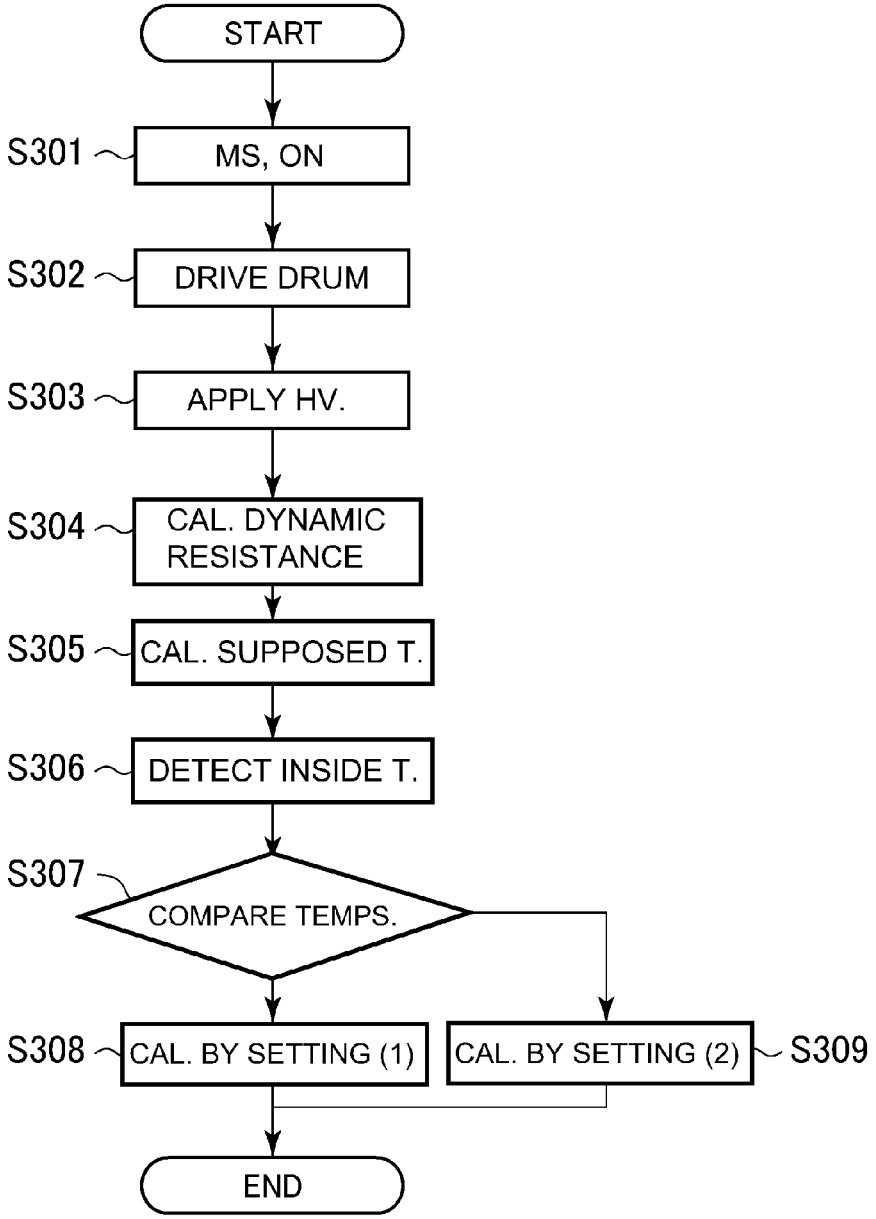
FIG. 14 is a flow chart in comparison example 3.

Referring to the flow chart of FIG. 14, the description will be made as to the charging voltage control using the apparatus-inside temperature/humidity sensor 110 and the current measurement circuit 13 in this comparison example. FIG. 14 is a flow chart of the operation to determine the charging voltage value.

The CPU101 as the controlling means controls various parts of the image forming apparatus A in accordance with the program stored in the ROM 103 as follows.

S301: the CPU101 checks whether the voltage source of the image forming apparatus A is actuated by the operator or not.

S302: the CPU101 instructs the printer controller 105 to carry out the program in the ROM 107. The printer controller 105 having received the instructions instructs the drive controlling portion 109 to drive the photosensitive member 1.

S303: the printer controller 105 as the setting portion instructs the high voltage controller 108 to apply the charging AC voltage on the basis of the program of the ROM 107.

S304: the printer controller 105 stores the value detected using the current measurement circuit 13 in the RAM 106, and calculates the dynamic AC resistance value.

Figure 15:
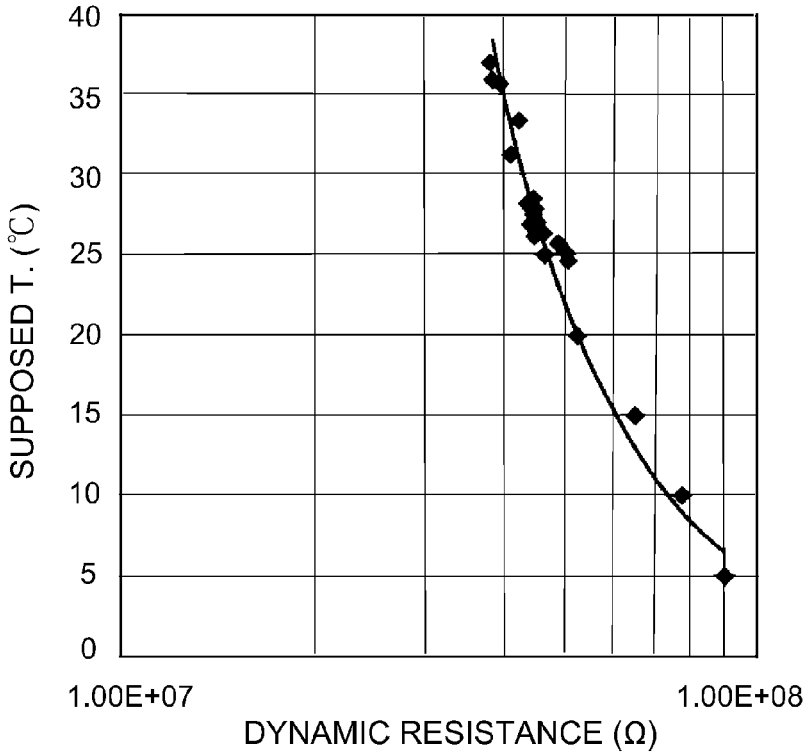
FIG. 15 is a graph of a relationship between a dynamic resistance and a supposed temperature.

S305: the printer controller 105 calculates a supposed temperature from the calculated dynamic AC resistance value, using a relationship preset in the ROM 107 between the dynamic AC resistance value and the supposed temperature as shown in FIG. 15.

S306: the printer controller 105 acquires temperature/humidity information from the apparatus-inside temperature/humidity sensor 110.

S307: the printer controller 105 compares these temperatures.

S308: the printer controller 105 uses, when the supposed temperature calculated from the dynamic AC resistance value is lower than the temperature acquired by the apparatus-inside temperature/humidity sensor 110, the charging AC setting based on the dynamic AC resistance value (setting (1)).

S309: the printer controller 105 uses, when the supposed temperature calculated from the dynamic AC resistance value is higher than the temperature acquired by the apparatus-inside temperature/humidity sensor 110, the charging AC setting (setting (2)) based on the apparatus-inside temperature/humidity sensor 110.

The relationship of FIG. 15 will be described. In FIG. 15, the abscissa is the dynamic AC resistance value and the ordinate is the supposed temperature. This relationship is obtained from the relationship at the time when the dynamic AC resistance of the charging roller 2 is measured under the same absolute water content ambient condition and a constant temperature ambient condition, separately.

More particularly, when the calculated dynamic resistance is 5.0E+07Ω (5.0×10^7Ω), the supposed temperature is 25 degree C. In this case, when the detected value by the apparatus-inside temperature/humidity sensor 110 is 20 degree C., the charging AC voltage for 20 degree C. is 2050V (setting (2)) from FIG. 9 in this comparison example. When the detected value by the apparatus-inside temperature/humidity sensor 110 is 30 degree C., the charging AC voltage for the 25 degree C. is 1750V (setting (1)) from FIG. 9 in this comparison example.

In this manner, in the image forming apparatus A of this comparison example, the first and second temperature detecting portions are provided as the temperature detecting portion. In this comparison example, the printer controller 105 functions as a selecting means for selecting one of a first temperature detection result of the first temperature detecting portion and a second temperature detection result of the second temperature detecting portion. The printer controller 105 as the setting portion sets the AC voltage of the charging bias voltage for the image forming operation using the selecting means temperature detection result selected by the selecting means. Particularly, in this comparison example, the first temperature detecting portion detects the temperature of the inside of the main assembly B of the image forming apparatus A. In addition, in this comparison example, the second temperature detecting portion comprises the current measurement circuit 13 as the resistance detection means. In this case, the second temperature detection result is a predicted value of the temperature of the charging roller 2 determined from the resistance detection result of the current measurement circuit 13 and the information indicative of the relation between the electric resistance of the charging roller 2 and the temperature stored in the ROM 107 as the second storing portion. In other words, in this case, the second temperature detecting portion is a prediction means for determining the predicted value of the temperature of the charging roller 2. The printer controller 105 as the selecting means selects the temperature detection result indicating a lower temperature from the first and second temperature detection results. The reason why the temperature detection result indicating the lower temperature is selected and used for the setting of the charging AC voltage is that there is a tendency that for a low temperature, a high charging AC voltage is required, and therefore, it is advantageous to select the lower one in order to suppress the occurrence of the improper charging.

The measurement timing in this comparison example may be the same as with the comparison example 1.

The determination of the supposed temperature from the dynamic AC resistance value in this comparison example can replace the detection of the apparatus-inside temperature in comparison example 1.

Comparison Example 4

A fourth comparison example of the charging voltage control relating to the image forming apparatus A of this embodiment will be described.

In this comparison example, an apparatus-outside temperature is detected using an apparatus-outside temperature/humidity sensor 111 in place of detecting the apparatus-inside temperature in comparison example 1. By doing so, the appropriate control can be accomplished when the exchanging unit such as a process cartridge 30 including the charging roller 2 is kept in the ambient condition range which can be detected by the apparatus-outside temperature/humidity sensor 111.

Figure 16:
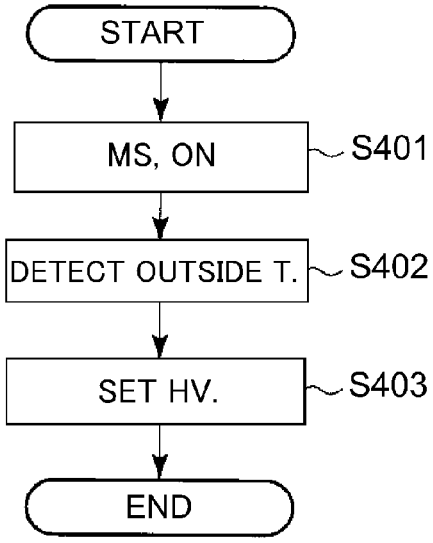
FIG. 16 is a flow chart in comparison example 4.

Referring to a flow chart of FIG. 16, the charging voltage control using the apparatus-outside temperature/humidity sensor 111 in this comparison example will be described. FIG. 16 is a flow chart of the operation to determine the charging voltage value.

The CPU101 as the controlling means controls various parts of the image forming apparatus A in accordance with the program stored in the ROM 103 as follows.

S401: the CPU101 checks whether the voltage source of the image forming apparatus A is actuated by the operator or not.

S402: the CPU101 instructs the printer controller 105 to carry out the program in the ROM 107. The printer controller 105 having received the instructions acquires the temperature/humidity information from the apparatus-outside temperature/humidity sensor 111.

S403: the printer controller 105 calculates a proper value from the acquired information using a relationship set in the ROM 107 between the temperature and the required charging AC voltage.

As for the required charging AC voltage, the relationship of FIG. 9 is usable similarly to comparison example 1. More specifically, when the temperature outside the image forming apparatus A is 20 degree C., for example, the charging AC voltage is 2050 Vpp from the relationship of FIG. 9.

The measurement timing in this comparison example may be the same as with the comparison example 1.

Comparison Example 5

A fifth comparison example of the charging voltage control relating to the image forming apparatus A of this embodiment will be described.

In this comparison example, the charging voltage setting is executed with even higher accuracy, from the detection result of the apparatus-outside temperature/humidity sensor 111 and the determination of the dynamic AC resistance value. For example, when the storage ambient condition of the exchanging unit such as a process cartridge 30 including the charging roller 2 and the temperature/humidity condition of the ambient condition measured by the apparatus-outside temperature/humidity sensor are remarkably different from each other, this comparison example is effective.

Figure 17:
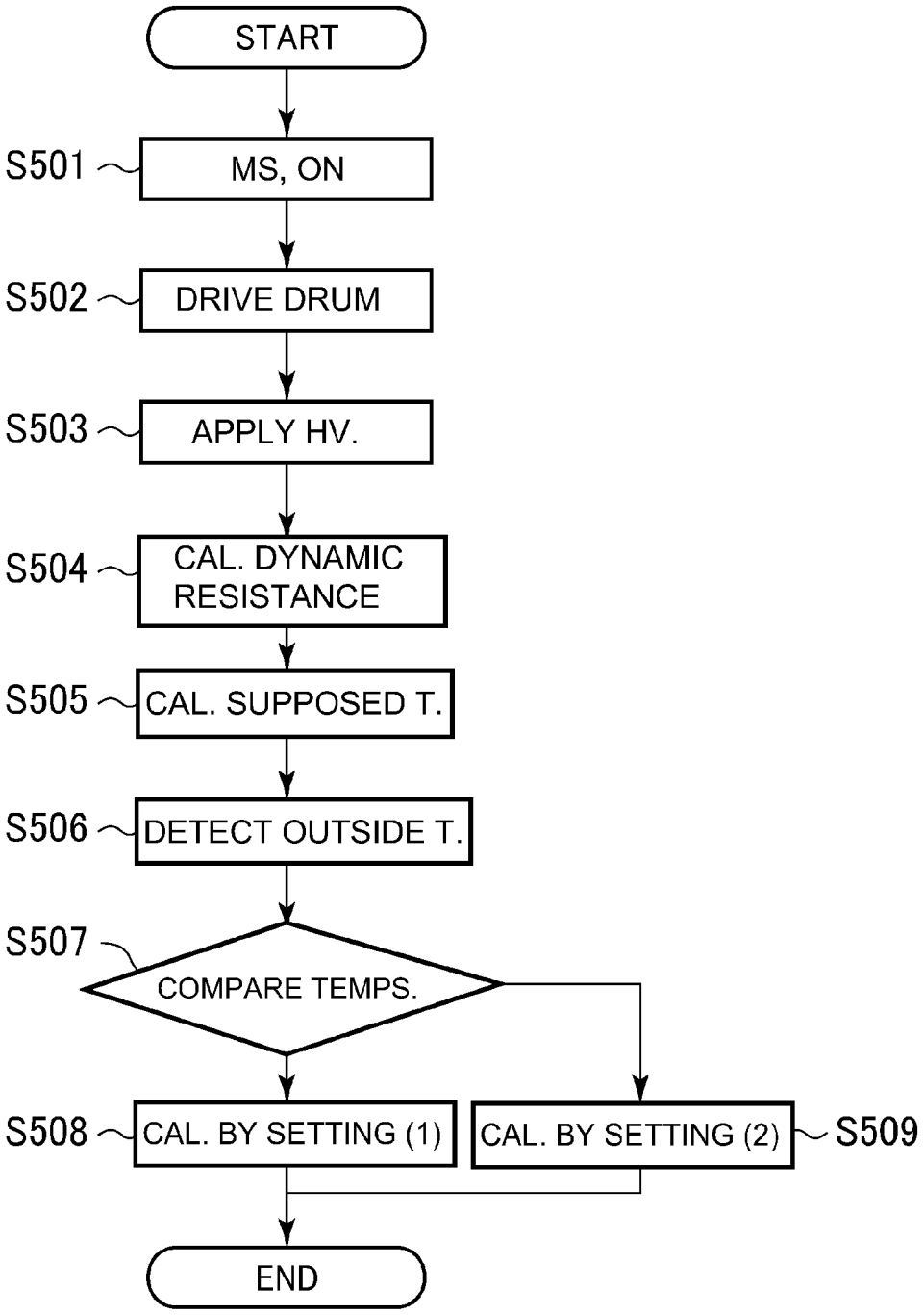
FIG. 17 is a flow chart in comparison example 5.

Referring to a flow chart of FIG. 17, the charging voltage control using the apparatus-outside temperature/humidity sensor 111 and the current measurement circuit 13 in this comparison example will be described. FIG. 17 is a flow chart of the operation to determine the charging voltage value.

The CPU101 as the controlling means controls various parts of the image forming apparatus A in accordance with the program stored in the ROM 103 as follows.

S501: the CPU101 checks whether the voltage source of the image forming apparatus A is actuated by the operator or not.

S502: the CPU101 instructs the printer controller 105 to carry out the program in the ROM 107. The printer controller 105 as the setting portion having received the instructions instructs the drive controlling portion 109 to drive the photosensitive member 1.

S503: the printer controller 105 instructs the high voltage controller 108 to apply the charging AC voltage on the basis of the program of the ROM 107.

S504: the printer controller 105 stores the value detected using the current measurement circuit 13 in the RAM 106, and calculates the dynamic AC resistance value.

S505: the printer controller 105 calculates a supposed temperature from the calculated dynamic AC resistance value, using a relationship preset in the ROM 107 between the dynamic AC resistance value and the supposed temperature as shown in FIG. 15.

S506: the printer controller 105 acquires temperature/humidity information from the apparatus-outside temperature/humidity sensor 111.

S307: the printer controller 105 compares these temperatures.

S508: the printer controller 105 uses, when the supposed temperature calculated from the dynamic AC resistance value is lower than the temperature acquired by the apparatus-outside temperature/humidity sensor 111, the charging AC setting based on the dynamic AC resistance value (setting (1)).

S509: the printer controller 105 uses, when the supposed temperature calculated from the dynamic AC resistance value is higher than the temperature acquired by the apparatus-outside temperature/humidity sensor 110, the charging AC setting (setting (2)) based on the apparatus-outside temperature/humidity sensor 111.

More particularly, when the calculated dynamic resistance is 5.0E+07Ω (5.0×10^7Ω), the supposed temperature is 25 degree C. In this case, when the detected value by the apparatus-outside temperature/humidity sensor 111 is 20 degree C., the charging AC voltage for 20 degree C. is 2050V (setting (2)) from FIG. 9 in this comparison example. When the detected value by the apparatus-outside temperature/humidity sensor 111 is 30 degree C., the charging AC voltage for the 25 degree C. is 1750V (setting (1)) from FIG. 9 in this comparison example.

Thus, in this comparison example, the first temperature detecting portion is a sensor for detecting a temperature of the outside of the main assembly B of the image forming apparatus, in place of the sensor for detecting the temperature of the inside of the main assembly B of the image forming apparatus A in comparison example 3.

The measurement timing in this comparison example may be the same as with the comparison example 1. By carrying out the measurement immediately after the exchange of the exchanging unit, the accuracy of the control can be improved.

Comparison Example 6

A sixth comparison example of the charging voltage control relating to the image forming apparatus A of this embodiment will be described.

In this comparison example, a further accurate charging voltage setting can be carried out from the detection result by the apparatus-inside temperature/humidity sensor 110, the detection result by the apparatus-outside temperature/humidity sensor 111 and the dynamic AC resistance value.

Figure 19:
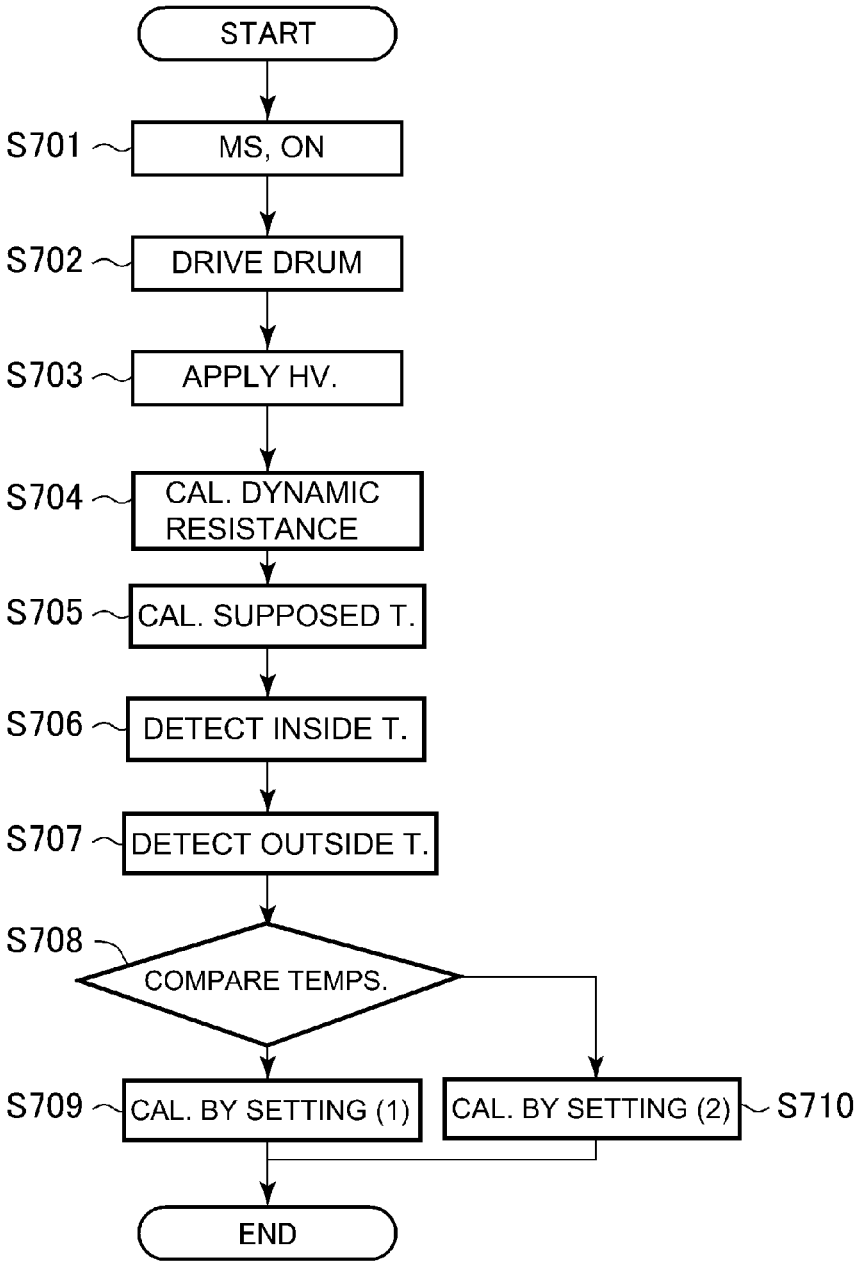
FIG. 19 is a flow chart in comparison example 6.

Referring to a flow chart of FIG. 19, a charging voltage control using the apparatus-inside temperature/humidity sensor 110, the apparatus-outside temperature/humidity sensor 111 and the current measurement circuit 13 in this comparison example will be described. FIG. 19 is a flow chart of the operation to the determination of the charging voltage value.

The CPU101 as the controlling means controls various parts of the image forming apparatus A in accordance with the program stored in the ROM 103 as follows.

S701: the CPU101 checks whether the voltage source of the image forming apparatus A is actuated by the operator or not.

S702: the CPU101 instructs the printer controller 105 as the setting portion to carry out the program in the ROM 107. The printer controller 105 having received the instructions instructs the drive controlling portion 109 to drive the photosensitive member 1.

S703: the printer controller 105 instructs the high voltage controller 108 to apply the charging AC voltage on the basis of the program of the ROM 107.

S704: the printer controller 105 stores the value detected using the current measurement circuit 13 in the RAM 106, and calculates the dynamic AC resistance value.

S705: the printer controller 105 calculates a supposed temperature from the calculated dynamic AC resistance value, using a relationship preset in the ROM 107 between the dynamic AC resistance value and the supposed temperature as shown in FIG. 15.

S706: the printer controller 105 acquires temperature/humidity information from the apparatus-inside temperature/humidity sensor 110.

S706: the printer controller 105 acquires temperature/humidity information from the apparatus-outside temperature/humidity sensor 111.

S708: the printer controller 105 compares the three temperatures.

S709: the printer controller 105 uses, when the supposed temperature calculated from the dynamic AC resistance value is close to the temperature acquired by the apparatus-inside temperature/humidity sensor 110, the charging AC setting based on the apparatus-inside temperature/humidity sensor 110 (setting (1).

S710: the printer controller 105 uses, when the supposed temperature calculated from the dynamic AC resistance value is close to the temperature acquired by the apparatus-outside temperature/humidity sensor 111, the charging AC setting based on the apparatus-outside temperature/humidity sensor 111 (setting (2).

It is assumed that, for example, that the detected value by the apparatus-outside temperature/humidity sensor 111 is 10 degree C., and the detected value by the apparatus-inside temperature/humidity sensor 110 is 23 degree C. When, on the other hand, the calculation result based on the dynamic AC resistance value is 5.0E+07Ω (5.0×10^7Ω), the supposed temperature (predicted temperature of the charging roller 2) predicted from the dynamic AC resistance value is 25 degree C. In this case, the detected value by the apparatus-inside temperature/humidity sensor 110 is closer to the supposed value based on the dynamic AC resistance value than the detected value by the apparatus-outside temperature/humidity sensor 111 (setting (1)).

In this manner, in this comparison example, the image forming apparatus A further comprises a third temperature detecting means as the temperature detecting means. Particularly, in this comparison example, the first temperature detecting means is a sensor for detecting the temperature of the inside of the main assembly B of the image forming apparatus A. The second temperature detecting means is a sensor for detecting the temperature of the outside of the main assembly B of the image forming apparatus A. The third temperature detecting means is constituted by the current measurement circuit 13 as the resistance detection means. The printer controller 105 as the setting portion selects such a temperature detection result of the first and second temperature detection results as indicates the temperature closer to the third temperature detection result.

The measurement timing in this comparison example may be the same as with the comparison example 1. By carrying out the measurement immediately after the exchange of the exchanging unit, the accuracy of the control can be improved. In addition, because the CPU101 is capable of discriminating the setting situation, a further accurate image forming condition can be set.

Embodiment

The description will be made as to the embodiment of the charging voltage control used in the image forming apparatus A of this embodiment.

In this embodiment, an even further accurate charging voltage setting is executed from the detection result by the apparatus-inside temperature/humidity sensor 110 as the first temperature detecting portion and the detection result by the apparatus-outside temperature/humidity sensor 111 as the second temperature detecting portion. For example, this embodiment is effective when the storage ambient condition of the exchanging unit such as the process cartridge 30 as the unit including the charging roller 2 as the charge portion is the ambient condition which can be measured by the apparatus-outside temperature/humidity sensor 111, and the temperature/humidity condition inside the main assembly B of the image forming apparatus A is remarkably different from the storage ambient condition of the exchanging unit.

Figure 18:
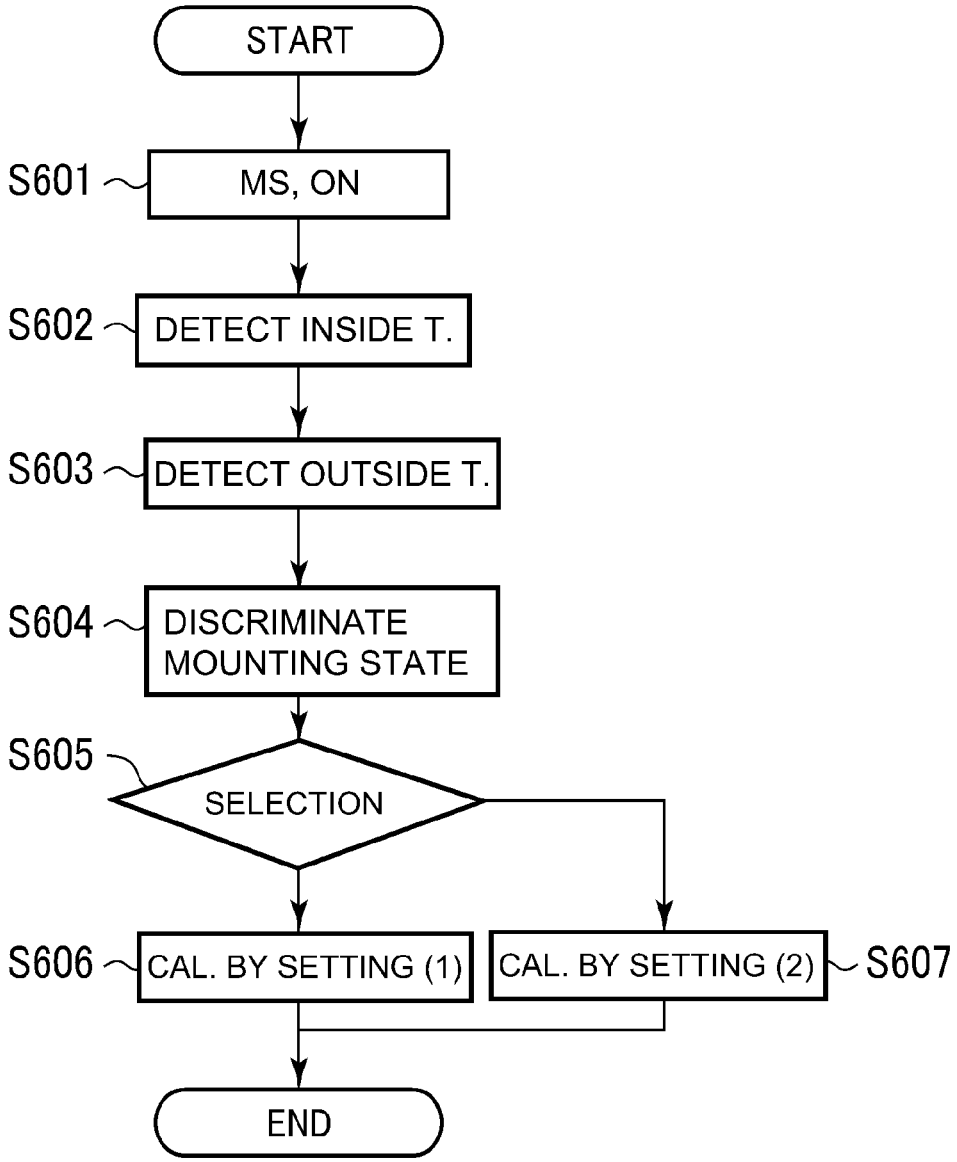
FIG. 18 is a flow chart according to an embodiment of the present invention.

Referring to a flow chart of FIG. 18, the description will be made as to the charging voltage control using the apparatus-inside temperature/humidity sensor 110 and the apparatus-outside temperature/humidity sensor 111 in this embodiment. FIG. 18 is a flow chart of the process up to the determination of the AC voltage (peak-to-peak voltage) in the charging bias voltage.

The CPU101 as the controlling means controls various parts of the image forming apparatus A in accordance with the program stored in the ROM 103 as follows.

S601: the CPU101 checks whether the voltage source of the image forming apparatus A is actuated by the operator or not.

S602: the CPU101 instructs the printer controller 105 as the setting portion to carry out the program in the ROM 107. The printer controller 105 having received the instructions acquires the temperature/humidity information from the apparatus-inside temperature/humidity sensor 110.

S503: the printer controller 105 acquires temperature/humidity information from the apparatus-outside temperature/humidity sensor 111.

S604: the printer controller 105 checks the mounting situation discrimination information acquired by the CPU101 as the mounting detecting portion. As will be described hereinafter, the mounting situation discrimination information is inputted by the operator to the CPU101 at an operating portion (unshown) of the main assembly B. The printer controller 105 discriminates whether or not the exchanging unit is exchanged, from the acquired mounting situation discrimination information.

S605: the printer controller 105 compares the temperature acquired from the result of the mounting situation discrimination and the apparatus-inside temperature/humidity sensor 110 and the temperature acquired from the apparatus-outside temperature/humidity sensor 111, and selects the temperature on which the charging AC voltage setting is to be executed.

S606: when the printer controller 105 discriminates that the exchanging unit is not exchanged or that although the exchanging unit is exchanged, the temperature acquired using the apparatus-inside temperature sensor 110 is lower, the charging AC setting based on the apparatus-inside temperature/humidity sensor 110 is used (setting (1)). S607: when the printer controller 105 discriminates that the exchanging unit is exchanged and that the temperature acquired using the apparatus-outside temperature sensor 111 is lower, the charging AC setting based on the apparatus-outside temperature/humidity sensor 111 is used (setting (2)).

The disposition situation discrimination at S604 in this embodiment will be further described. When the operator exchanges the exchanging unit, for example, an initial setting is necessary. This setting is carried out only when the exchanging unit is exchanged, and therefore, this is the condition on which the mounting of new exchanging unit by the exchange of the exchanging unit is discriminated. The CPU101 is capable of discriminating that the exchanging unit is kept outside the main assembly B of the image forming apparatus A by receiving the information from the operator. Therefore, the current state of the exchanging unit can be correctly discriminated. Alternatively, the operator may positively input the information indicating that the exchanging unit has been kept outside of main assembly B of the image forming apparatus A.

It is assumed for example that the detected value by the apparatus-outside temperature/humidity sensor is 20 degree C., the detected value by the apparatus-inside temperature/humidity sensor is 30 degree C., and the CPU101 acquires a flag (mounting situation discrimination information) indicating that the exchanging unit has been exchanged by the mounting situation discrimination. In this case, on the basis of the relationship of FIG. 9, the charging AC voltage of 2050V for temperature 20 degree C. is set (setting (2)). On the other hand, when the detected value by the apparatus-outside temperature/humidity sensor is 20 degree C., the detected value by the apparatus-inside temperature/humidity sensor is 30 degree C. similarly, but the flag is not raised, the charging AC voltage (peak-to-peak voltage) of 1550V for temperature 30 degree C. is set on the basis of the relationship of FIG. 9. In addition, even if the flag is raised, the charging AC voltage is set on the basis of the detected value of the apparatus-inside temperature/humidity sensor 110 if the temperature acquired using the apparatus-inside temperature/humidity sensor 110 is lower than the temperature acquired using the apparatus-outside temperature/humidity sensor 111 (setting (1)).

In this manner, in this embodiment, when the exchange of the exchanging unit including the charging roller 2 is detected, the printer controller 105 as the setting portion compares the first temperature detection result which is the apparatus-inside temperature detection result and the second temperature detection result which is the apparatus-outside temperature detection result and executes a second set mode in which the peak-to-peak voltage of the AC voltage is superimposed on the charging bias voltage on the basis of the detection result indicating a lower detected temperature. On the other hand, when the exchanging unit is not exchanged, a first set mode is executed in which the peak-to-peak voltage of the AC voltage to be superimposed on the charging bias voltage on the basis of the first temperature detection result which is the apparatus-inside temperature detection result. Particularly in this embodiment, when the exchanging unit including the charging roller 2 is exchanged and the second temperature detection result which is the apparatus-outside temperature detection result is lower than the first temperature detection result which is the apparatus-inside temperature detection result, the second temperature detection result which is the apparatus-outside temperature detection result is selected. The exchanging unit is often stored in a place where the temperature is lower than that of the inside of the main assembly B of the image forming apparatus A. Therefore, it may be that when the exchange of the exchanging unit including the charging roller 2 and therefore the mounting of the new exchanging unit are detected, the second temperature detection result which is the apparatus-outside temperature detection result is always selected. In addition, it may be as desired that in consideration of the delay until the temperatures of various members approach the temperature therearound, such a temperature detection result of the apparatus-inside temperature detection result and the apparatus-outside temperature detection result as indicates the lower temperature is selected.

The measurement timing in this embodiment may be the same as those of comparison example 1, and depending on the installed ambient condition of the image forming apparatus, the temperatures may be detected in real time or at predetermined regular intervals. For example, by carrying out the detection immediately after the exchange of the exchanging unit, the accuracy of the control will be improved. The setting operation of the charging AC voltage (peak-to-peak voltage) by the setting portion in this embodiment can be carried out during a non-image-formation period similarly to comparison example 1, wherein the non-image-formation period includes the initial rotating operation (multiple pre-rotation step) period, the printing preparation rotating operation (pre-rotation step) period, the sheet interval period in the continuous image formation and the post-rotation step period. In addition, in the case that the delay time until the temperature of the mounted exchanging unit approaches the apparatus-inside temperature (1 hour, for example), the second set mode may be carried out in which the temperature acquired by the apparatus-inside temperature sensor 110 and the temperature acquired by the apparatus-outside temperature sensor 111 are compared, and the lower temperature is selected for the setting of the AC voltage in the charging bias voltage, for a predetermined period (1 hour, for example) after the detection of the mounting of the exchanging unit. In such a case, it may be that the relationship between the temperatures of the apparatus-outside temperature sensor 111 and in the apparatus-inside temperature sensor 110 when the mounting of the exchanging unit is detected and the time period until the temperature of the charging roller 2 approaches the apparatus-inside temperature is stored beforehand in a storing portion such as a ROM, for example, and the time period until the temperature of the exchanging unit approaches the apparatus-inside temperature is determined on the basis of the stored relationship.

Other Embodiments

The image forming apparatus is not limited to the type in which the toner image is transferred onto the recording material by way of an intermediary transfer member, but is applicable to a type in which the toner image is directly transferred onto the recording material from the photosensitive member.

In the foregoing embodiments, the image forming apparatus comprises a cleaning device as the means for removing the untransferred toner, but the present invention is applicable also to a cleanerless type image forming apparatus comprising charge regulating means for the untransferred toner to accomplish collection simultaneously with development by the developing device.

In addition, the present invention is applicable to the image forming apparatus including the contact charging type device in at least one image forming station and a temperature/humidity detecting means adjacent to the contact charging member, for example.

Moreover, the charging roller may comprise a core metal and an electroconductive elastic layer of SBR (styrene butadiene rubber) on which electroconductive carbon is dispersed, concentrically on the outer periphery. Furthermore, the charging roller may be an electroconductive elastic roller comprising a high resistance coating layer on the above-described outer periphery to prevent improper charging, and a protection coating layer thereon to prevent sticking of the charging roller on the photosensitive member.

INDUSTRIAL APPLICABILITY

According to the present invention, the occurrence of non-uniform charging of the surface of the photosensitive member can be suppressed even when temperature of the charging member newly mounted to the image forming apparatus by the exchange is lower than the temperature in the image forming apparatus.

The invention claimed is:

1. An image forming apparatus comprising:

a photosensitive member;

a charge portion for charging said photosensitive member, said charge portion being capable of mounting to or dismounting from said image forming apparatus;

an applying portion for applying to said charge portion a charging bias voltage comprising a DC voltage and a superimposed AC voltage;

a toner image forming portion for forming a toner image on said photosensitive member charged by said charge portion;

a transfer portion for transferring the toner image formed on said photosensitive member onto a recording material;

a fixing portion for fixing the transfer toner image on the recording material by heat and pressure;

a first casing accommodating therein said photosensitive member, said charge portion, said applying portion, said toner image forming portion, said transfer portion and said fixing portion, said first casing being provided with an opening for permitting the recording material to enter;

a second casing disposed at a lower position with respect to a vertical direction outside said first casing and accommodating therein a recording material accommodating portion which accommodates the recording material;

a feeding portion for feeding the recording material into said first casing through said opening;

a first temperature detecting portion, provided in said first casing, for detecting a temperature inside said first casing;

a second temperature detecting portion, disposed in said second casing, for detecting a temperature inside said second casing;

a mounting detecting portion for detecting a mounting operation of said charge portion to said image forming apparatus; and a setting portion for executing an operation in a first set mode for setting a peak-to-peak voltage of the AC voltage of the charging bias voltage on the basis of a detection result of said first temperature detecting portion, wherein when said mounting detecting portion detects the mounting operation, said setting portion executes an operation in a second set mode for setting the peak-to-peak voltage of the AC voltage on the basis of a detection result of a lower one of a temperature detected by said first temperature detecting portion and a temperature detected by said second temperature detecting portion.

2. An apparatus according to claim 1, wherein said charge portion constitutes a unit detachable from said image forming apparatus integrally with said photosensitive member and said toner image forming portion, and said first temperature detecting portion is disposed in a position opposing said unit in said image forming apparatus to which said unit is mounted.

3. An apparatus according to claim 1, wherein said second casing includes a frame supporting said recording material accommodating portion and an outer casing member, said second temperature detecting portion being disposed between said frame and said outer casing member.

4. An apparatus according to claim 1, wherein when a detected temperature used for the setting is a first temperature, said setting portion sets the peak-to-peak voltage of the AC voltage to a first voltage, and when the detected temperature used for the setting is a second temperature which is lower than the first temperature, said setting portion sets the peak-to-peak voltage of the AC voltage to a second voltage which is higher than the first voltage.

5. An apparatus according to claim 1, wherein said setting portion sets the peak-to-peak voltage of the AC voltage at predetermined timing in a non-image-formation period.

6. An apparatus according to claim 1, wherein said setting portion executes the operation in the second set mode.

* * * * *